US006234473B1

(12) United States Patent
Morgan et al.

(10) Patent No.: US 6,234,473 B1
(45) **Date of Patent: *May 22, 2001**

(54) ZERO FEED INTERRUPT SHEET STACKER

(75) Inventors: Robert A. Morgan, Benecia; Lynn T. Beckwith, Oakland; George L. Matlock, Pleasanton, all of CA (US)

(73) Assignee: Martin Family Trust, Oakland, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/290,478

(22) Filed: Apr. 12, 1999

Related U.S. Application Data

(63) Continuation-in-part of application No. 08/979,012, filed on Nov. 26, 1997, now Pat. No. 6,042,108.

(51) Int. Cl.[7] ..... B65H 29/50

(52) U.S. Cl. ..... 271/201; 271/200; 271/218; 414/789.9; 414/790.8

(58) Field of Search ..... 271/200, 201, 271/217, 218, 158; 414/789.9, 790.8

(56) References Cited

U.S. PATENT DOCUMENTS

| | | |
|---|---|---|
| 1,711,827 | 5/1929 | Berry . |
| 2,660,432 | 11/1953 | Wilske et al. . |
| 3,148,780 | 9/1964 | Lindemann . |
| 3,241,692 | 3/1966 | Johnson . |
| 3,321,202 | 5/1967 | Martin . |
| 3,411,638 | 11/1968 | Dryon . |
| 3,419,266 | 12/1968 | Martin . |
| 3,724,640 | 4/1973 | Rapparlie . |
| 3,902,711 | 9/1975 | Lenoir . |
| 4,006,831 | 2/1977 | Jimenez . |
| 4,188,861 | 2/1980 | Kroeze et al. . |
| 4,279,555 | 7/1981 | Rydell . |
| 4,452,442 | 6/1984 | Geschwinder et al. . |
| 4,712,787 | 12/1987 | Princiotta, Sr. . |
| 5,813,826 | 9/1998 | Martin et al. . |
| 5,829,951 | 11/1998 | Adami . |
| 5,873,974 | 2/1999 | Marschke et al. . |
| 5,882,175 | 3/1999 | Fernandez . |

FOREIGN PATENT DOCUMENTS

| | | |
|---|---|---|
| 359593 | 2/1962 | (CH) . |
| 1116239 | 11/1961 | (DE) . |
| 1145637 | 3/1963 | (DE) . |
| 2302955 | 7/1974 | (DE) . |
| 27 15705A1 | 11/1977 | (DE) . |
| 3028865 | 2/1982 | (DE) . |
| 923596 | 4/1963 | (GB) . |
| 1196687 | 7/1970 | (GB) . |
| Y1-46-2296 | 1/1971 | (JP) . |
| 0119655 | 9/1980 | (JP) . |
| 1-252462 | 10/1989 | (JP) . |
| 4-144835 | 5/1992 | (JP) . |
| 8-217308 | 8/1996 | (JP) . |

*Primary Examiner*—H. Grant Skaggs
(74) *Attorney, Agent, or Firm*—James R. Cypher; Charles R. Cypher

(57) ABSTRACT

A zero feed interrupt sheet stacker conveying an uninterrupted stream of sheets in which a sheet accumulator catches holds and deposits a stack of sheets upon a load receiving device. The accumulator includes a curtain which is extended into the stream of sheets at a selected point between two sheets. The curtain type apparatus provides a platform in which the portion of the platform in contact with the carried sheets does not move relative to the sheet while it is extending, during holding, or during retraction of the platform.

13 Claims, 27 Drawing Sheets

ZERO FEED INTERRUPT SHEET STACKER

This application is a continuation-in-part of U.S. application Ser. No. 08/979,012, filed Nov. 26, 1997 now U.S. Pat. No. 6,042,108, granted Mar. 28, 2000, which is hereby incorporated herein by reference.

BACKGROUND OF THE INVENTION

Field of the Invention

This invention relates to sheet stackers such as U.S. Pat. No. 3,321,202 granted to M. D. Martin on May 23, 1967 and U.S. Pat. No. 3,419,266 granted to M. D. Martin on Dec. 31, 1968. Specifically, the foregoing sheet stackers handled corrugated and paper board sheets used in making boxes.

The Martin U.S. Pat. No. 3,41 9,266 sheet stacker was provided with an accumulator device which caught the trailing edge and two lead corners of the sheets as they fell from the downstream end of the conveyor. Sheets having die cuts which did not form rigid corners presented problems in accumulating sheets. Long sheets with such weak corners which exceeded the extension capacity of the cross bar holding the trailing edge of the sheet and a portion of the midportion of the sheet could not be accommodated.

Sheets having die cuts which cause flaps or tabs to hang downwardly as the sheet exits the downstream end of the conveyor are sometimes bumped by the leading edge of the rapidly extending cross bar of the Martin U.S. Pat. No. 3,41 9,266 accumulator causing the sheet to be skewed and preventing a straight stack from being formed. Such jams in the stacker require stopping the production line which not only causes a delay but more serious problems result if a box printer or a die cutter is in the upstream production line. Such stoppages can require throwing away partially cut or printed sheets before the production line can be restarted.

In those production lines where the sheets are shingled; i.e. overlapped on the conveyor and are discharged in a continuous stream from the discharge end of the conveyor without gaps or interruptions between sheets, the problem of extending a cross bar or fingers into this stream of sheets at a selected point so as to maintain an accurate count of sheets in a particular stack is not only difficult because the leading edge of the fingers strike the sheets and skew them, but the problem is exacerbated by the flaps and tabs which hang down below the plane of the sheet member.

SUMMARY OF THE INVENTION

The present invention addresses the foregoing problems by fundamentally changing the apparatus used to insert a platform between the sheets falling from the downstream end of a conveyor and then to firmly support the accumulating sheets. Moreover, the apparatus of the present invention also fundamentally changes the way in which the stack of accumulated sheets are discharged onto a load receiving device such as a pallet or conveyor.

The present invention presents a significant improvement in the ability to stack sheets; especially those sheets which have die cuts which result in flaps and tabs which bend downwardly as the sheet free falls from the downstream end of a conveyor onto an accumulator platform.

In general, the present invention discloses a curtain type apparatus which provides a platform in which the portion of the platform in contact with the carried sheet does not move relative to the sheet while it is extending, during holding, or during retraction of the platform.

An object of the present invention is to provide a device which can insert a platform between selected sheets being discharged from a conveyor in either a sequential or a shingled uninterrupted stream without slowing, stopping or interrupting the feed to the conveyor or the stream of sheets while on the conveyor.

An object of the present invention is to catch, hold and release a plurality of sheets while minimizing movement of the sheet from a selected path onto a stack.

A further object is to provide a device which can stack sheets which have been die cut to an extent that present accumulator devices cannot stack such sheets without excessive downtime.

A still further object is to provide a device which can stack sheets much larger in area than can presently be processed in present machines.

Still another object is to provide a machine which can build stacks closer longitudinally to a previously constructed stack than is possible with present machines.

A still further object is to provide a stacker which can operate more reliably, more accurately, and with less down time than present stackers.

BRIEF DESCRIPTION OF THE DRAWINGS

FIG. 26 shows the curtain tension motor, one of the mounting plates, a portion of one of the means for maintaining a horizontal position. Portions of the curtain take up roll and accumulator drive train are shown, along with guide wheels for one of the side rails.

BRIEF DESCRIPTION OF THE INVENTION

Figure 16:
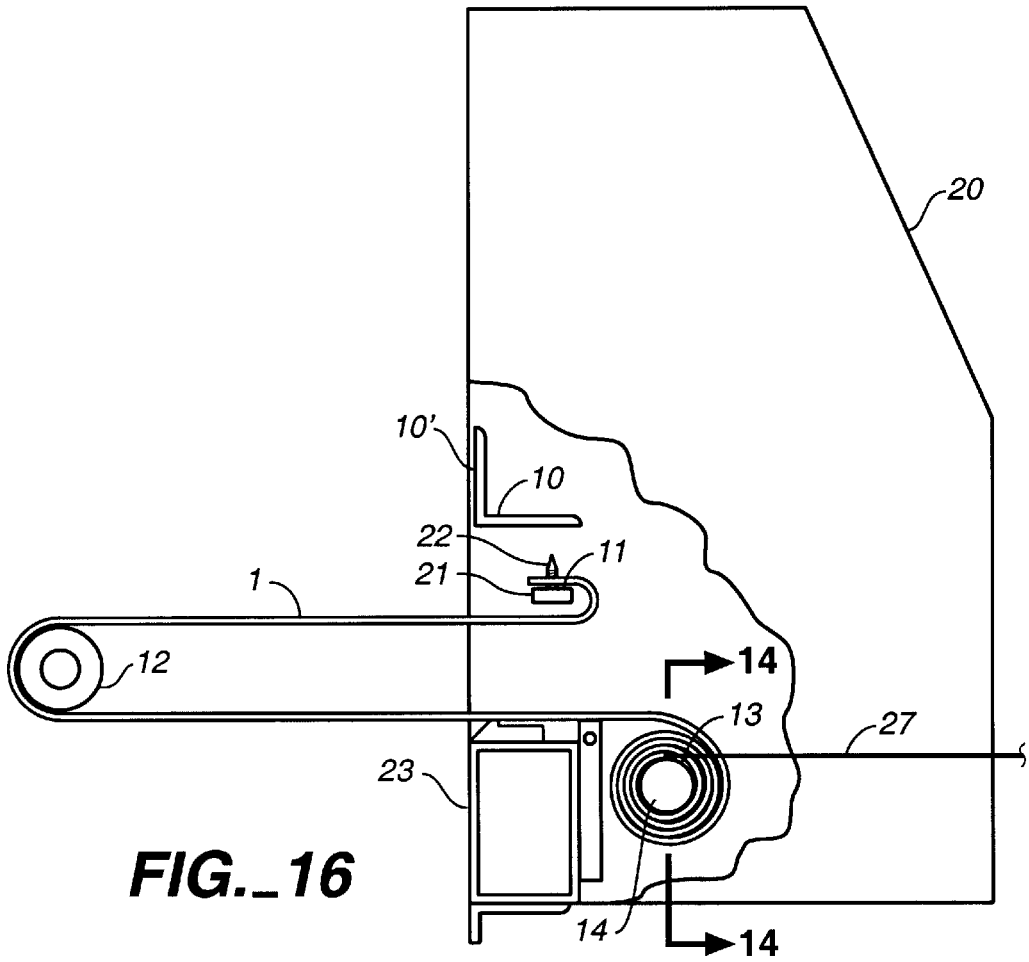
FIG. 16 is a schematic view of the curtain, the clamping device at the fixed end of the curtain and the take up roll at the other end of the curtain.

The basic function of the Zero Feed Interrupt Sheet Stacker (S) of the present invention is to stack sheets continuously without interrupting the flow of sheets fed to the machine. The invention may be most easily understood by referring to FIGS. 4A through 4E. One of the features of the present invention is the use of a device which will hereafter be sometimes referred to as "the curtain" and designated by the number 1. The curtain 1 is inserted into a stream of sheets 2 entering at an upstream receiving end 5 and falling from the downstream delivery end 3 of a conveyor 4 at a selected point. The point selected for insertion is most commonly the space between the last sheet 2' of a completed stack 6 and the first sheet 2" of a new stack 6'. Sheet accumulator means 7 including curtain 1 temporarily holds a plurality of accumulated sheets 2'" and then discharges them onto a load receiving means 9 such as a pallet or conveyor. In its simplest form, the curtain 1 consists of a flexible sheet attached at one end 11 to a clamping device 10 as shown in FIG. 16. The flexible curtain member 1 is extended out from the fixed end 11 generally horizontally and wound over a leading edge member such as lead roller 12 with the other end 13 spirally wound on a take up roll 14 best shown in FIG. 16. The lead roller 12 which is also shown in FIGS. 2, 5A, 5B, 5C, 7, and 16 is mounted for rotation on the lead ends of side rails 16 and 16'.

Figure 1:
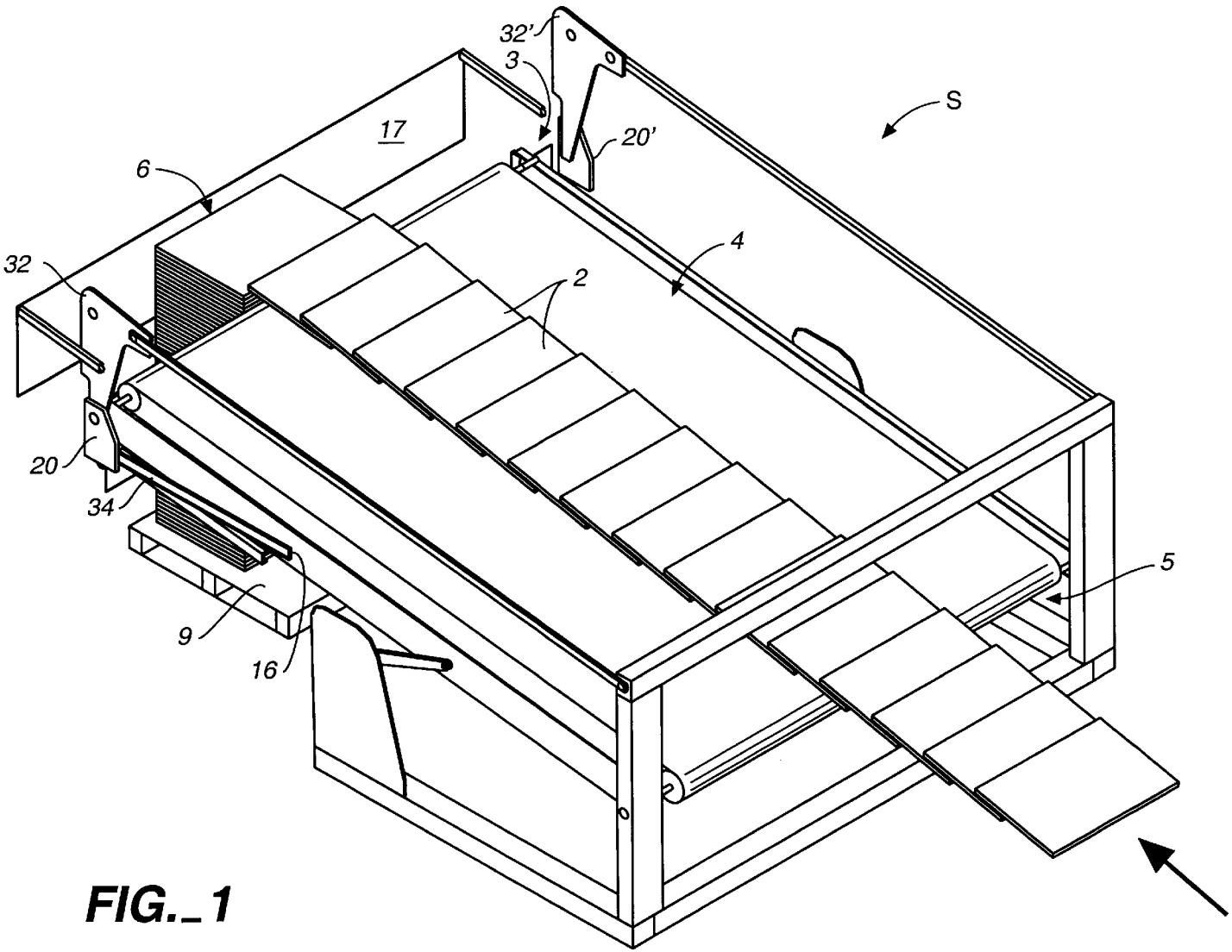
FIG. 1 is an isometric view of a portion of the zero feed interrupt sheet stacker of the present invention with portions removed to more clearly show the path of shingled sheets as they enter the schematically indicated conveyor portion and are discharged to a stack.
Figure 4A:
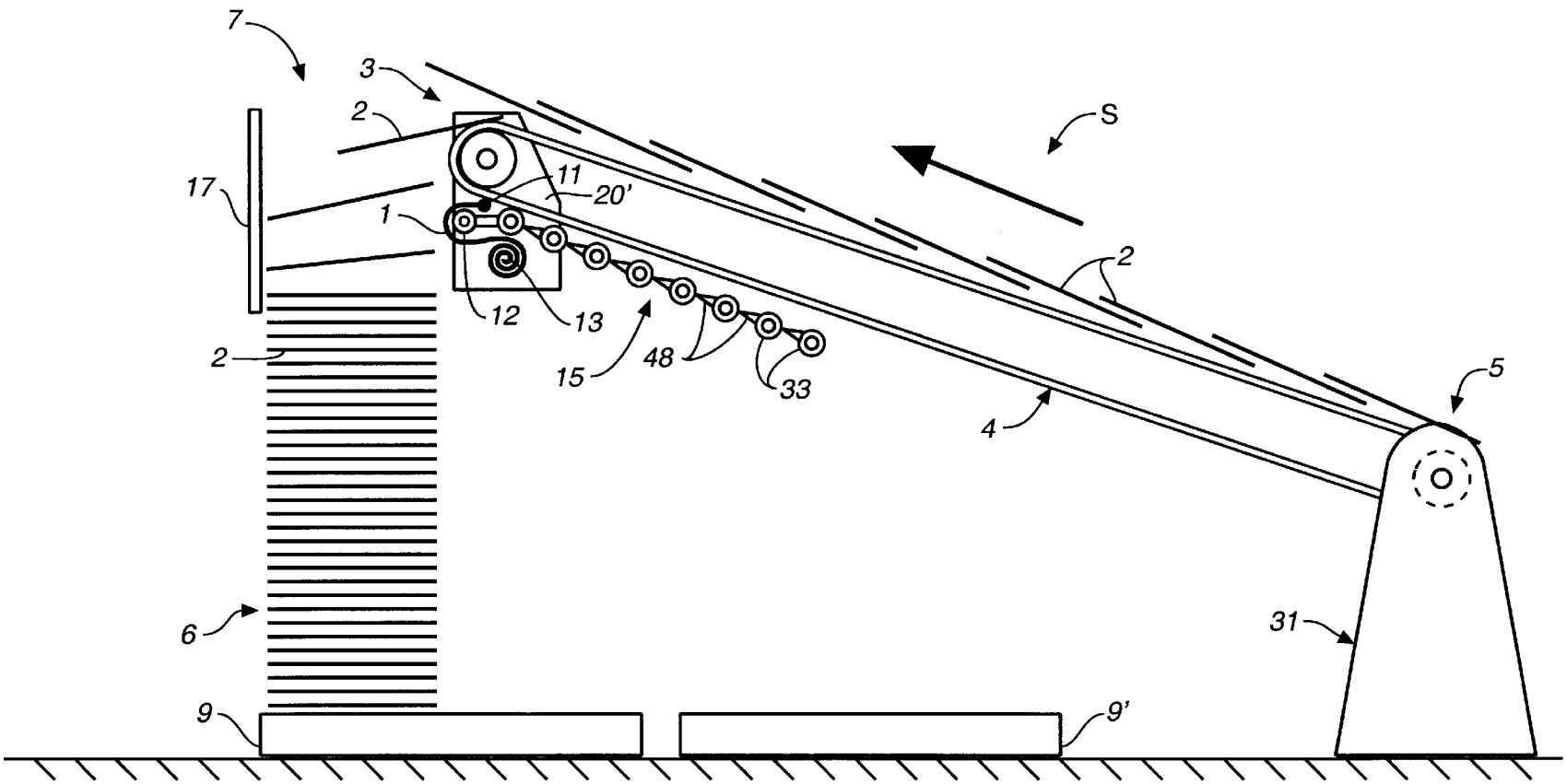
FIG. 4A is a schematic side view of the zero feed interrupt sheet stacker shown in FIG. 1 showing the stacker conveying shingled sheets, discharging them from the downstream delivery end of the conveyor and building a stack of sheets on a first load receiving pallet. The arrow indicates that the delivery end of the conveyor rises as the stack builds to reduce the distance the sheet falls from the delivery end of the conveyor to the stack. The curtain and curtain support members are shown retracted as the stack builds.

Referring to FIG. 4A sheets 2 such as corrugated paper board used in making card board boxes is fed to a conveyor 4 from a machine such as a die cutter, a conveyor for stripping the die cut matter from the sheets or a card board printing machine. The conveyor 4 is preferably one that can raise and lower; such as the conveyor described in U.S. Pat. No. 3,419,266 granted to Merrill D. Martin. The sheets ride the conveyor usually in shingled form with an overlap of up to about 75%. As the sheets fall off the downstream delivery end 3 of the conveyor 4 they strike a back stop member 17 and come to rest on a load receiving pallet 9 or a standard conveyor as shown in FIG. 1 of U.S. Pat. No. 3,419,266, preferably, pallets 9 and 9' ride a standard roller conveyor such as the one shown in U.S. Pat. No. 5,813,826. As taught by U.S. Pat. No. 3,419,266, the stack 6 is best formed by a conveyor 4 in which the delivery end 3 rises as the stack 6 builds so that the distance that each sheet 2 falls will be minimized.

Figure 4B:
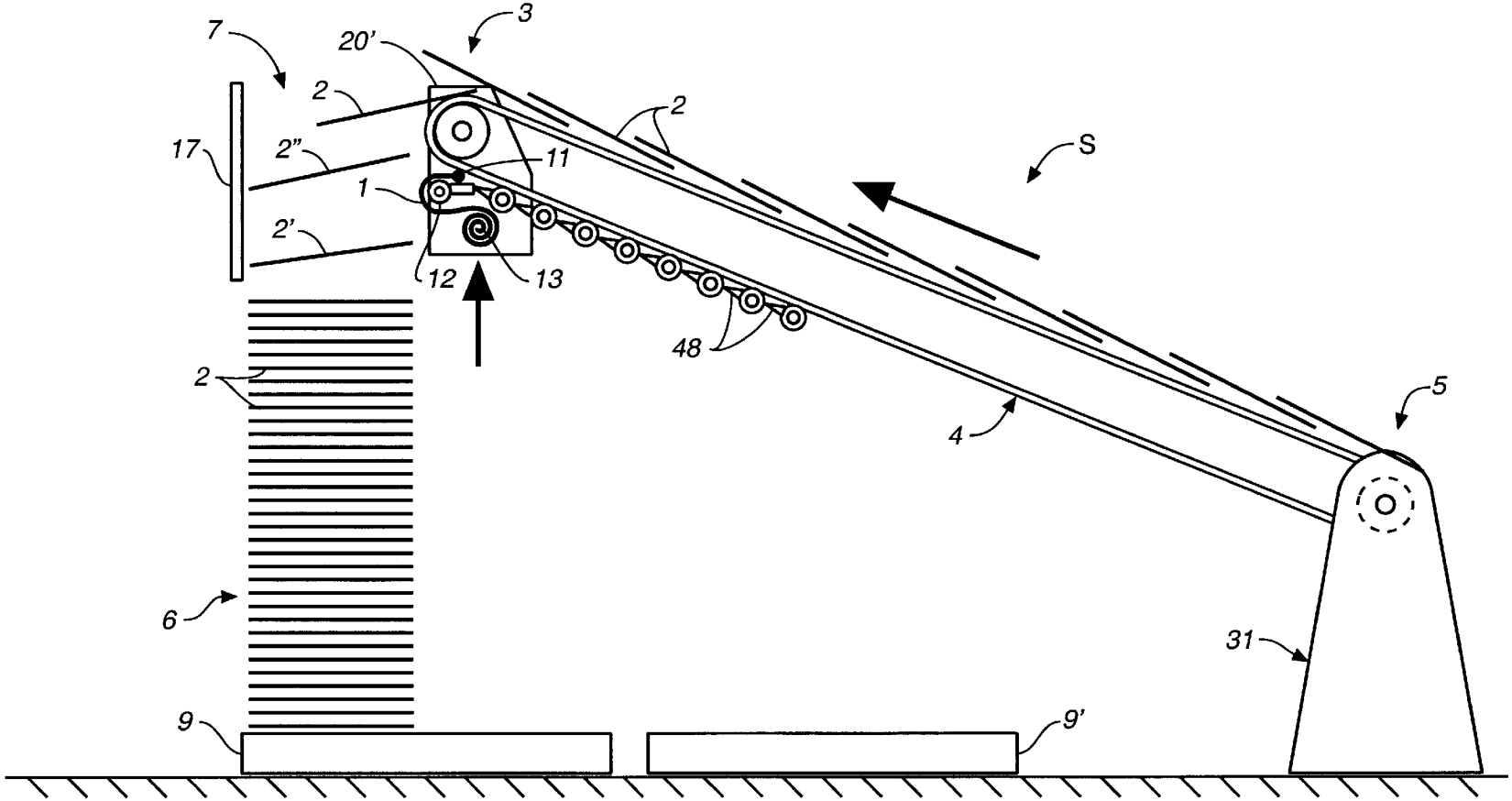
FIG. 4B is a schematic side view of the zero feed interrupt sheet stacker shown in FIG. 4A with the curtain of the platform assembly poised for extension between the last sheet of the stack and the first sheet of a new stack.

FIG. 4B illustrates the position of the conveyor 4 and curtain 1 as the last sheet 2' is falling on stack 6 and the curtain 1 is poised to extend and catch the first sheet 2" of a new stack 6'.

Figure 4C:
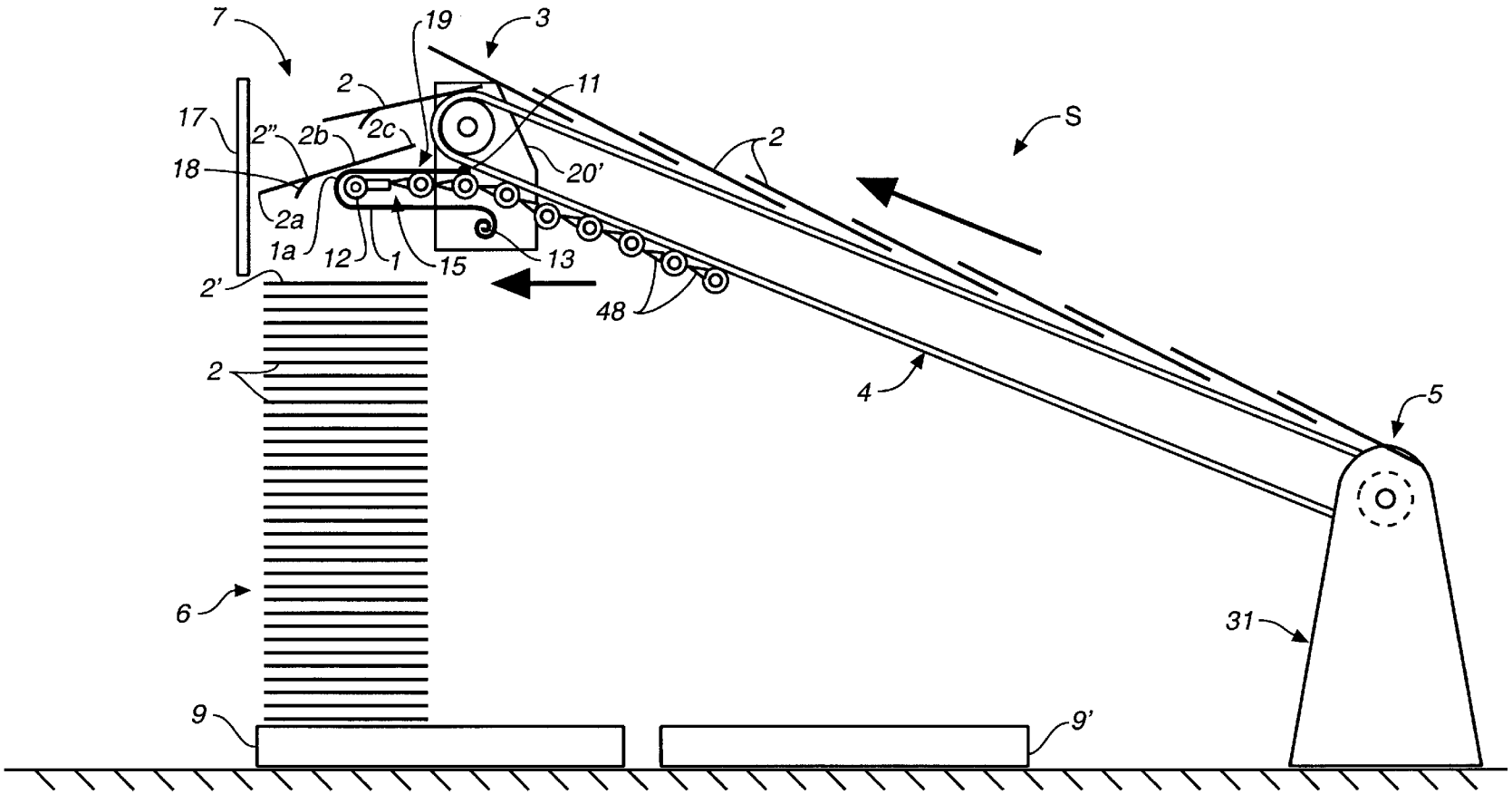
FIG. 4C is a schematic side view of the stacker shown in FIGS. 4A and 4B showing the curtain partially extended so as to catch the first sheet of a new stack.

FIG. 4C illustrates the position of platform assembly 15 and curtain 1 partially inserted between the last sheet 2' on stack 6 and the first sheet 2" of the next stack to be built. Sheet 2" as illustrated in FIG. 4C is inclined at an angle with the lead edge 2*a* resting against back stop member 17, the mid portion 2*b* balanced on the curved portion 1*a* of curtain 1, and the trailing edge 2*c* above curtain 1. Where sheets 2 are closely spaced or shingled, as illustrated, or the conveyor 4 is moving the sheets very rapidly, the space between sheets 2 as they fall from the downstream delivery end 3 of conveyor 4 is quite small. It is therefor necessary for the platform assembly 15 to extend very rapidly. It has been found that the platform assembly 15 need only be accelerated in the extension mode to a point where the curtain contacts about the midpoint 2*b* of the sheet 2 so as to arrest its fall. Further extension of the platform assembly 15 may proceed at a more leisurely rate at a constant velocity. As the platform assembly 15 nears the lead edge 2*a* of the sheet 2, the platform assembly 15 decelerates at a slow deceleration rate until further extension stops.

An unexpected result of using a curtain 1, is the fact that jamming of the machine due to skewing of the sheets 2 occurs less frequently. Not only does the curtain 1 result in less skewing due to impacts with the trailing edges 2*c* of sheets 2, but there is also less skewing due to the catching of flaps or tabs 18 hanging down from the sheets 2. This reduction in jamming is due to an "endless track" effect which is not unlike the effect of a Caterpillar® or other endless-track tractor moving across terrain littered with stones and brush. Thus as the platform assembly 15 including lead roller 12 is extended and deploys curtain 1, there is no relative horizontal movement between the sheet 2 whose forward motion has been stopped by the backstop member 17 and the variable area supporting platform 19 once the portion of the curtain 1 moving upwardly over the lead roller 12 reaches the horizontal plane of the extending platform assembly 15. The variable area supporting platform 19 may be defined by referring to FIG. 4C in which the length may be roughly defined by the distance between the mid portion 2*b* and the trailing edge 2*c* of the sheet 2.

Figure 4D:
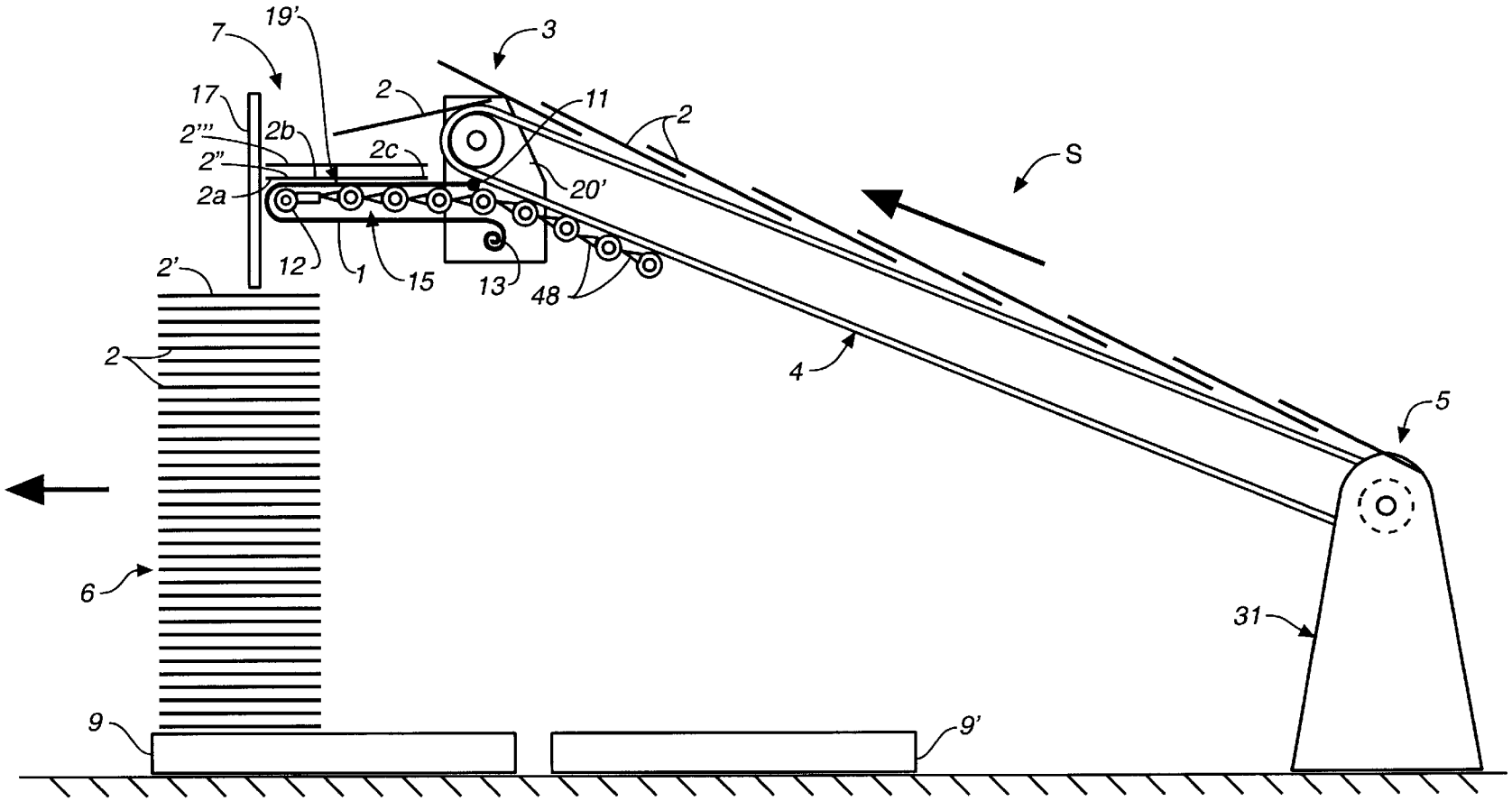
FIG. 4D is a schematic side view of the stacker shown in FIGS. 4A, 4B and 4C showing the curtain fully extended below an accumulating stack of sheets. The arrow indicates that the first load receiving pallet is moving to the left so that a second stack can be built on the first pallet. The conveyor and back stop have been raised to clear the first stack and are about ready to move downwardly to start a second stack on the first pallet.

As the platform assembly 15 extends to the position illustrated in FIG. 4D, the variable area supporting platform increases to a larger area indicated by the number 19'. The length of the variable area supporting platform 19' is now approximately equal to the distance between leading edge 2*a* and trailing edge 2*c* of sheet 2. The increase in length of the variable area supporting platform 19' increased considerably, yet there was no relative movement between the curtain 1 and the sheet 2" while the variable area supporting platform 19 was increasing. Thus, just as the endless-track tractor can move freely over rocks or brush, so too can the curtain 1 of the present invention move a flap 18 up to a planar position with the plane of sheet 2 without bumping the sheet to a skewed position as occurred with prior art rapidly extending sheet catching bars or fingers as taught by Martin U.S. Pat. No. 3,419,266 and all others.

Figure 4E:
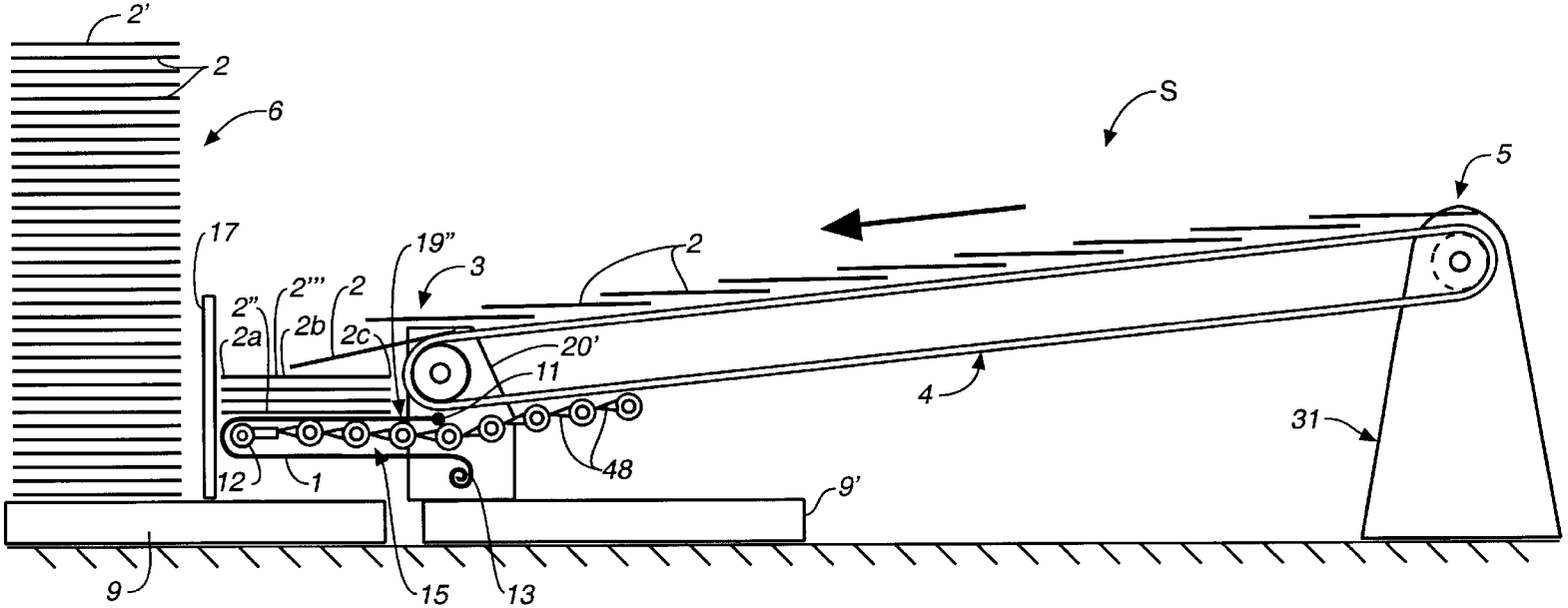
FIG. 4E is a schematic side view of the stacker shown in FIGS. 4A, 4B, 4C, and 4D showing the conveyor in maximum lowered position.

FIG. 4E illustrates conveyor 4 in a fully lowered position. Note that pallet 9 has been moved to a position so that back stop 17 just barely clears stack 6, and the sheets 2'" accumulated on the curtain 1 do not have far to drop. In this lowered position, platform assembly 15 begins to retract, which permits the accumulated sheets 2'" to tip onto their leading edges 2*a* against the top surface of pallet 9. Remarkably, retraction of platform assembly 15 to the position shown in FIG. 4F does not create any drag on sheet 2' because there is no relative movement between curtain 1 which constitutes the variable area supporting platform 19" and sheet 2" which is the first sheet or bottom sheet of stack 6'—the second formed stack on pallet 9.

Figure 4F:
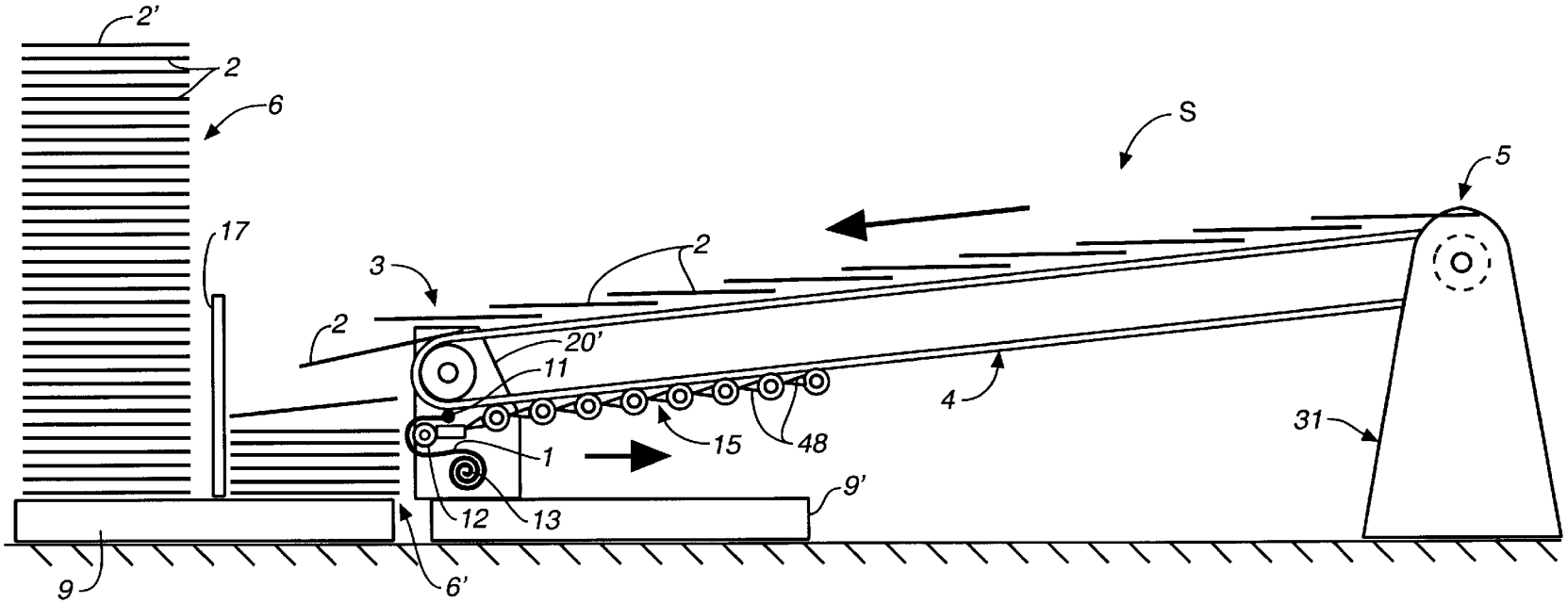
FIG. 4F is a schematic side view of the stacker shown in FIGS. 4A, 4B, 4C, 4D, 4E and 4F showing the curtain retracted and the conveyor building a second stack on the first pallet. The second pallet has been moved into position behind the first pallet in position to replace the first pallet.
Figure 5A:
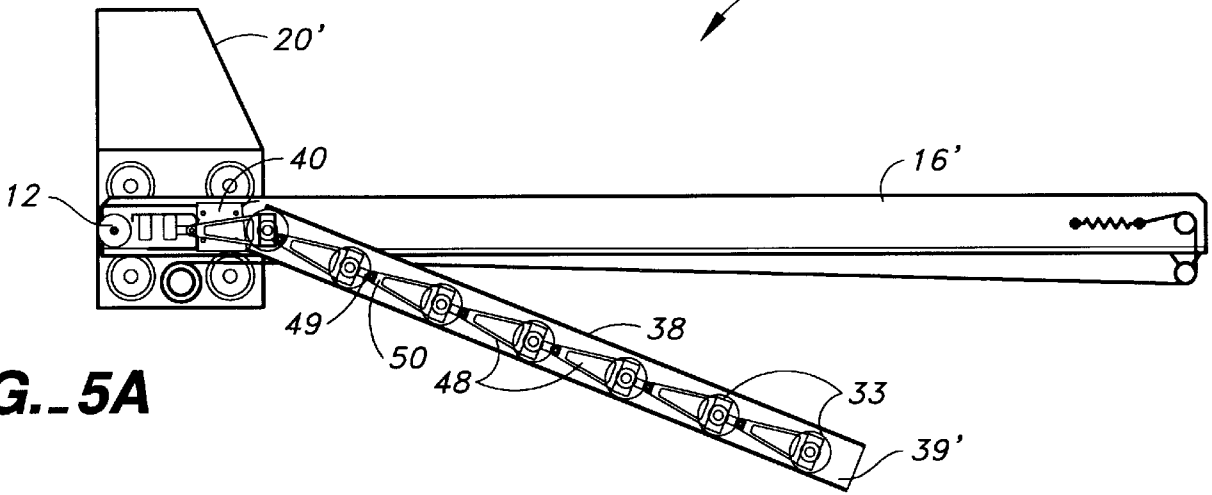
FIG. 5A is a side view of a portion of the accumulator assembly with the platform assembly retracted and the curtain support members fully retracted into the magazine assembly.
Figure 5B:
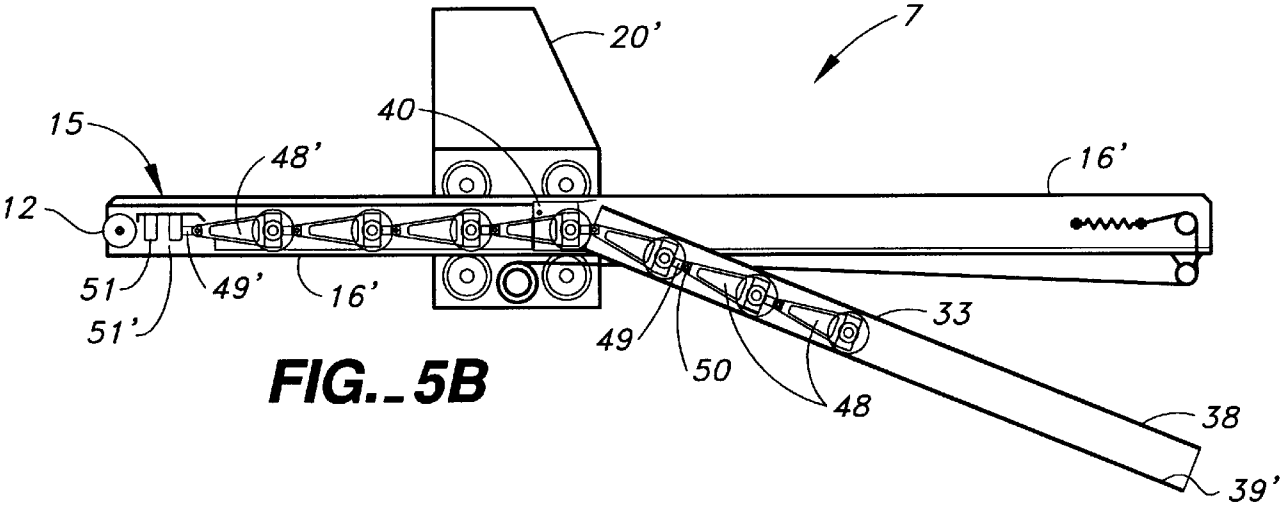
FIG. 5B is a side view similar to FIG. 5A with the platform assembly partially extended.
Figure 5C:
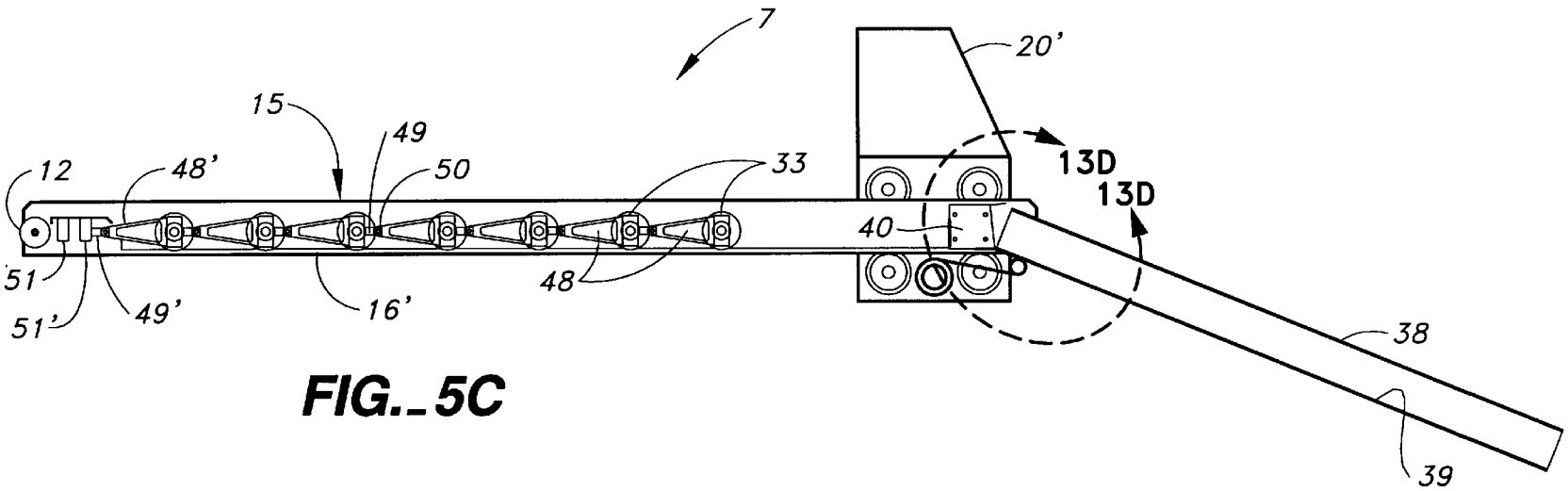
FIG. 5C is a side view similar to FIG. 5A and 5B with the platform assembly fully extended.
Figure 6:
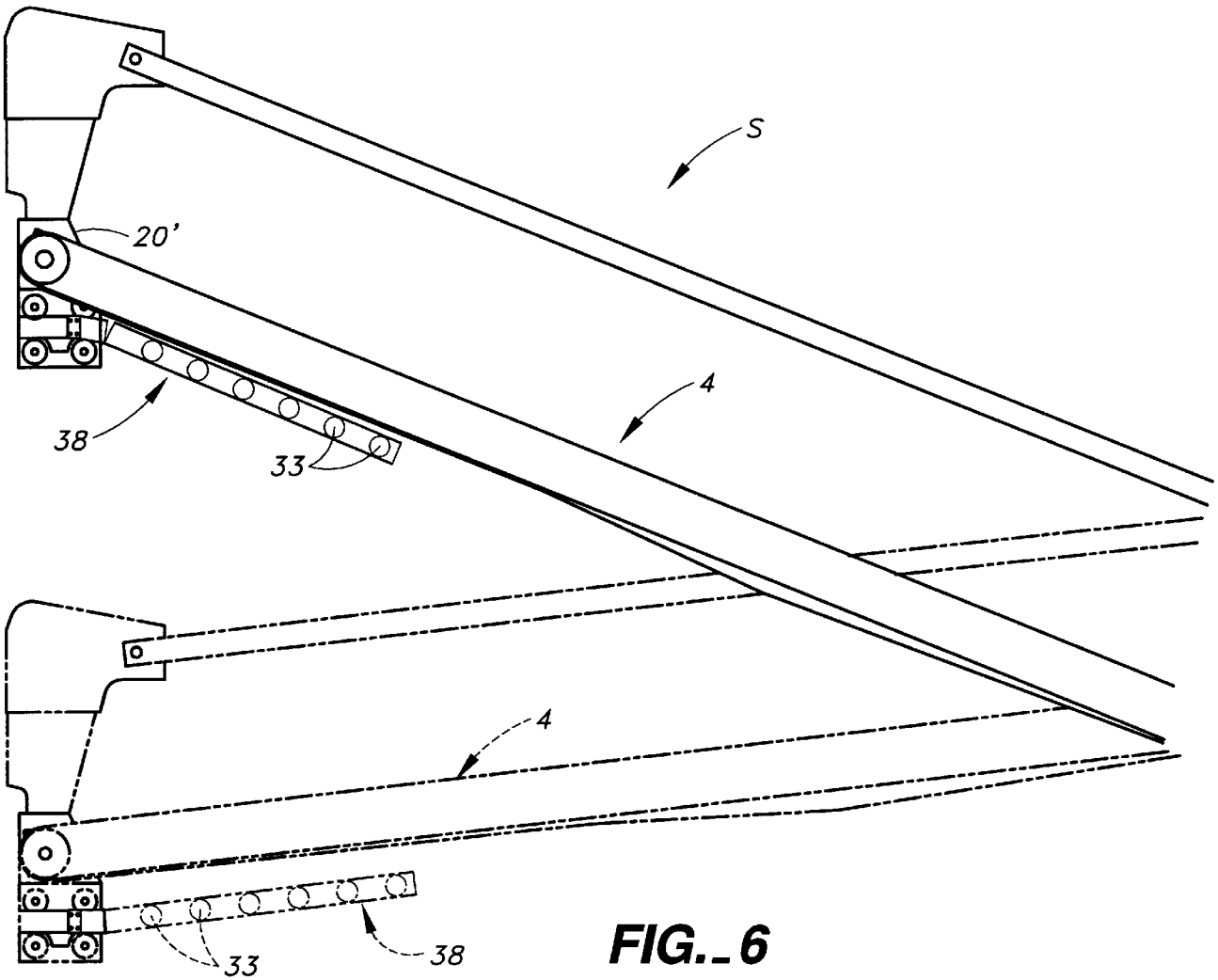
FIG. 6 is a schematic side view of the conveyor illustrated in FIG. 1. The solid line view illustrates the position of the magazine assembly relative to the conveyor in the maximum raised position. The phantom lines show the position of the magazine assembly in the maximum lowered conveyor position.
Figure 7:
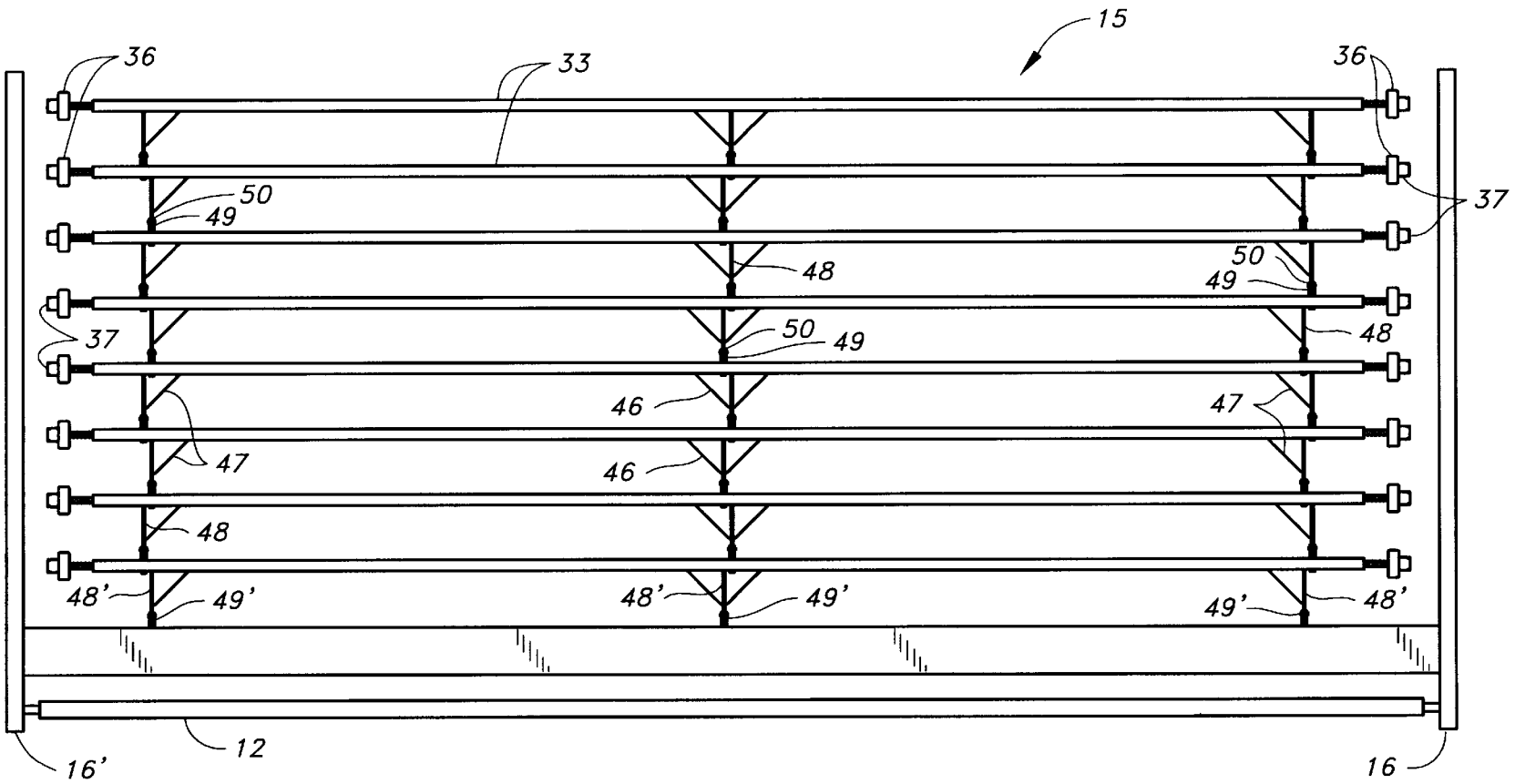
FIG. 7 is a top plan view of the platform assembly with the curtain removed.

FIG. 4F shows the position of conveyor 4 with platform assembly 15 fully retracted. As sheets 2 build on pallet 9, conveyor 4 rises until it reaches the position illustrated in FIG. 4*c* and the process repeats as above described.

Figure 2:
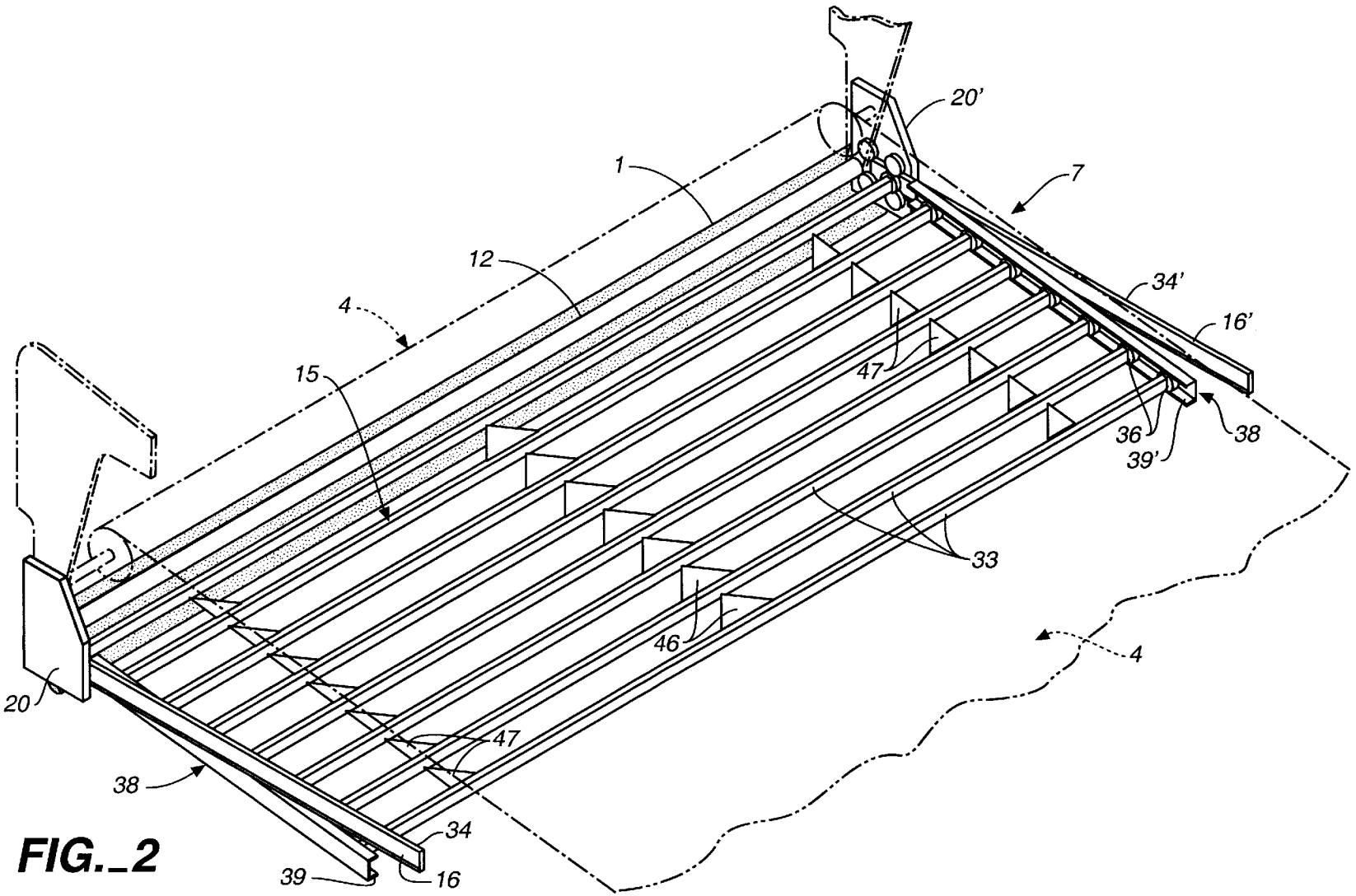
FIG. 2 is an isometric view of a portion of the accumulator assembly mounted below the conveyor shown in FIG. 1 shown in enlarged scale. Specifically, a portion of the curtain, leading edge member and curtain support members are shown in relation to the conveyor belt.

Leading edge member 12 is illustrated in FIGS. 2, 4(A–F), 5(A–C) and 7 as an elongated roller 12 mounted for rotation. While clearly this is the best mode known and developed, the leading edge member 12 could be a fixed or rotating member of various geometric shapes and sizes. It is believed that the leading edge member 12 should be made as small as practicable, yet an evenly rounded edge of a fairly large radius is also practical in enabling the leading edge member to avoid pushing a sheet askew and to gently drop the accumulated sheets 2'" onto a load receiving means such as a pallet or conveyor 9.

The first end 11 and second end 13 of curtain 1 are illustrated in FIGS. 4(A–F) and 16. As illustrated, means such as clamp means 10 fixedly attach first end 11 by means of an angle member 10' and flat bar 21 held by threaded nuts and bolts 22. The clamping means 10 are attached to mounting plates 20 and 20'. While the best mode is illustrated, the clamping means 10 could be held at a point further away from leading edge member 12.

Figure 14:
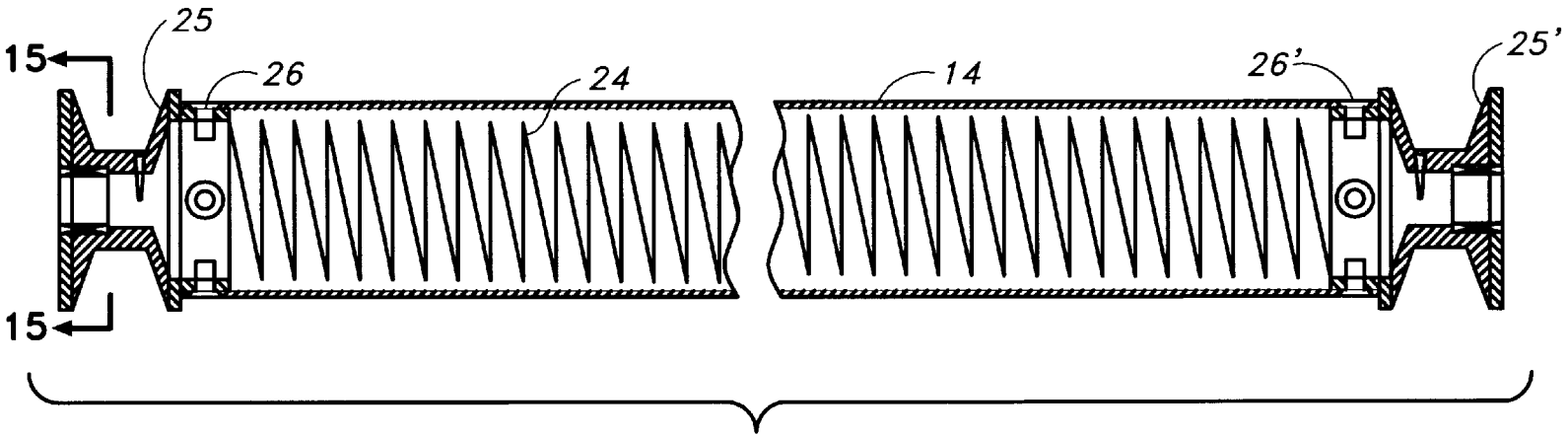
FIG. 14 is side cross sectional view of the curtain take up roll taken generally along line 14—14 on FIG. 16.
Figure 26:
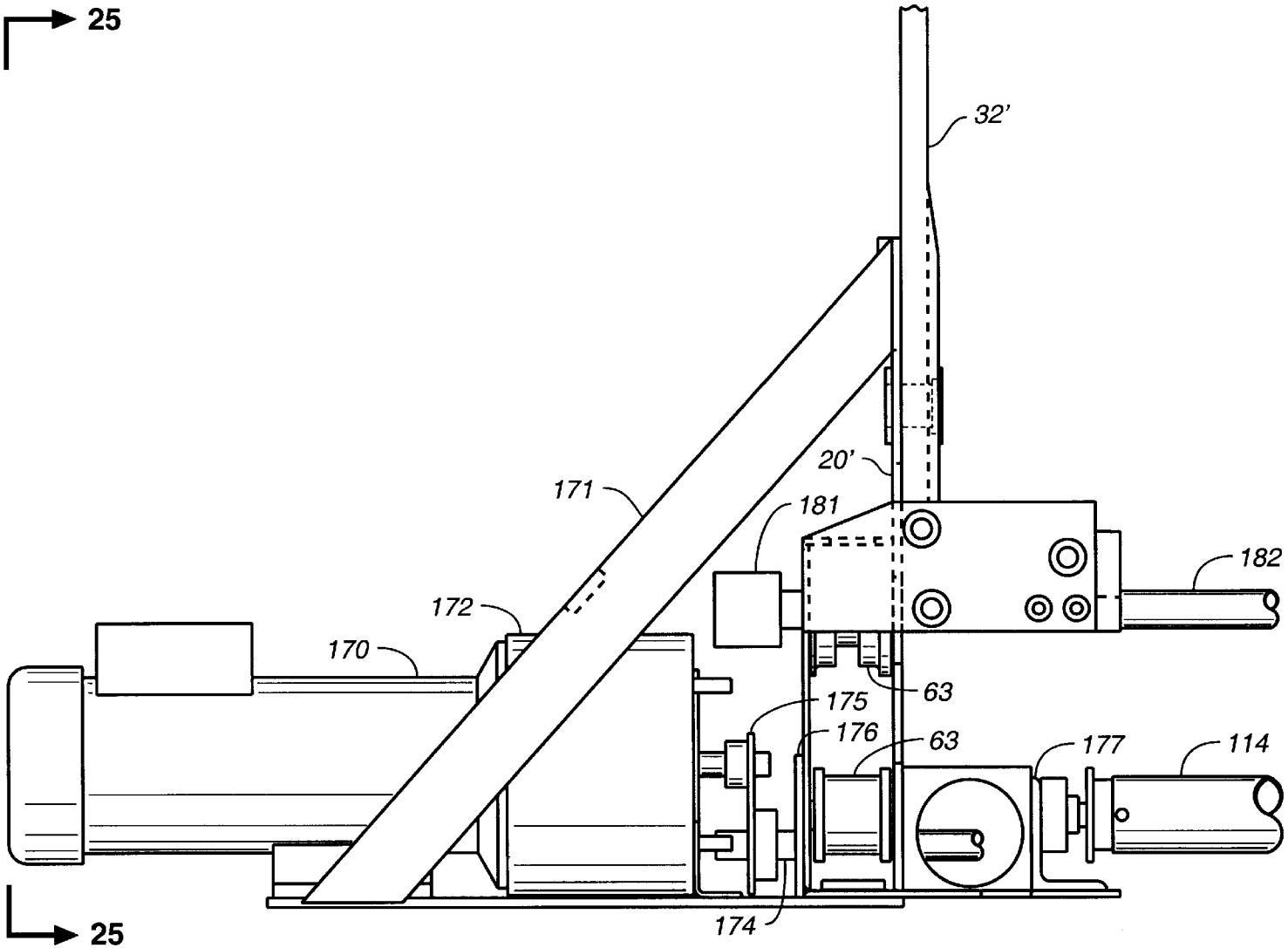
FIG. 26 is taken along view line 26—26 of FIG. 25.

The other end 13 of curtain 1 is attached to a scrolling means, such as the take up roll 14 illustrated in FIG. 14. An alternate take up roll 114 is also shown in FIG. 26. Take up rolls 14 and 114 as shown in FIGS. 16 and 26 are attached to mounting plates 20 and 20' behind cross tube member 23. Curtain 1 may be spirally wound on take up rolls 14 or 114. When curtain 1 is extended by moving lead roller 12 to the left as shown in FIG. 16, curtain 1 unwinds from take up roll 14 or 114. Curtain 1 should be held taught at all times and spirally wound quickly on take up rolls 14 or 114, when the platform assembly 15 is retracted.

Figure 15:
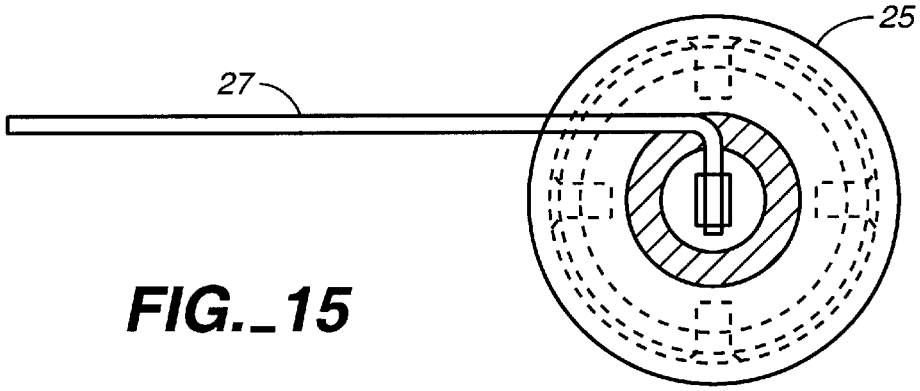
FIG. 15 is a cross sectional view of the cable take up reel taken along line 15—15 of FIG. 14.

While the two take up rolls 14 and 114 function similarly there are differences. The embodiment of the take up roll 14 shown best in FIGS. 14, 15 and 16 is discussed first. When curtain 1 is extended by moving lead roller 12 to the left as shown in FIG. 16, curtain 1 unwinds from take up roll 14.

Figure 17:
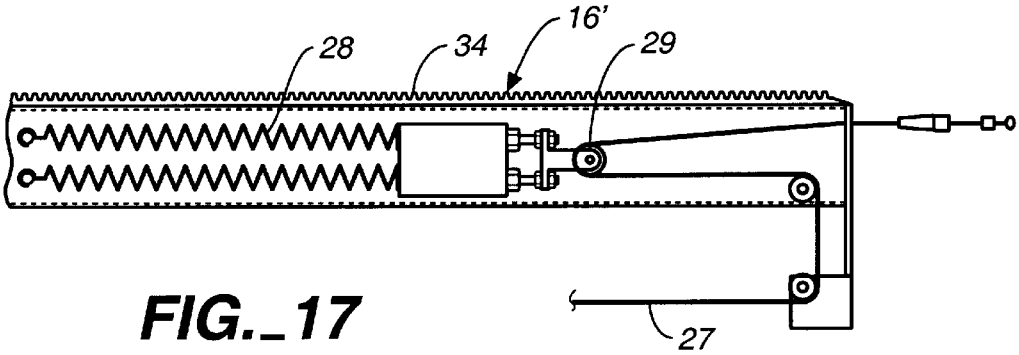
FIG. 17 is a side view of the side rail with portions removed to illustrate a tension spring and pulley used to tension the curtain take up roll.

At the same time, turning of take up roll 14 tensions spring 24 mounted within take up roll 14 so that during retraction of curtain 1, spring 24 drives take up roll 14 in the opposite direction to spirally wind curtain 1 back on take up roll 14. Since curtain 1 should be held taught at all times and spirally wound quickly on take up roll 14, it has been found that operation is improved by operatively attaching tensioning means to the scrolling means. The tensioning means may include cable take up reels 25 and 25' connected to the distal ends 26 and 26' of hollow tube 14. A pair of cables 27 are connected respectively to each of said cable take up reels 25 and 25' and to a pair of second tensioning springs 28 one of which is illustrated in FIG. 17. In operation, when curtain 1 is extended, cable reels 25 and 25' turn with tube 14 which winds cables 27 on reels 25 and 25'. Winding of cables 27 pulls on pulleys 29 which stretches springs 28. When curtain 1 is to be retracted, spring 24 and springs 28 operate to provide the force necessary to retract the curtain 1 .

Referring to FIGS. 4(A–F), means 31 are provided for selectively lowering and raising the downstream delivery end 3 of the conveyor means 4. Such lowering and raising means is well known in the art. See for example Martin U.S. Pat. No. 3,419,266.

Referring to FIG. 1, means 32 and 32' are provided for retaining platform means 15 of the accumulator means 7 at a relatively horizontal position at all elevations of the downstream delivery end 3 of the conveyor means 4. Such means for maintaining a horizontal position is well known in the art. See for example Martin U.S. Pat. No. 3,419,266.

A feature of the present invention is that a second stack 6' or multiple stacks may be built very close to a first stack 6 and subsequent stacks. As illustrated in FIGS. 4E and 4F, a second stack may in fact be built on a single pallet 9. This feature is possible because the platform assembly and curtain 1 provide nearly full length support to the sheet 20 as opposed to prior art stackers which provide only front edge support to the sheet and thus edge support is required to be provided by the back stop. In this invention, no edge support is provided by back stop member 17 and thus it can be made very narrow as illustrated in FIG. 3A. As shown in FIGS. 4E and 4F, thin back stop member 17 requires very little distance between stacks 6 and 6'. Means, not shown, for moving pallets 9 and 9' may be by hand or preferably by powered rollers upon which pallets 9 and 9' ride.

Referring particularly to FIGS. 2, 4(A–F), 5(A–C) and 7, sheet accumulator means 7 includes curtain support members 33 which are operatively connected to leading edge roller 12 for extension and retraction movement therewith and are connected to one another in a chain.

Accumulator means 7 includes a pair of spaced side rails 16 and 16' shown in FIGS. 12, 8, 9, 10 and 18 and a gear rack member 34 and 34' carried respectively on the top of each side rail 16 and 16'. Outer wheel rails 35 are mounted on each of the spaced side rails 16 and 16' respectively and spaced side rails 16 and 16' carry the leading edge roller 12.

Referring to FIGS. 2, and 7–10, primary wheel members 36 are connected to curtain support members 33. Each primary wheel member 36 has an outer wheel member 37 mounted outwardly thereto. Outer wheel members 37 are dimensioned and positioned for operative engagement with the outer wheel rails 35 mounted on side rails 16 and 16'. A magazine assembly 38 is connected to the conveyor means 4 and includes a pair of spaced primary wheel tracks 39 and 39' for receiving and supporting the primary wheel members 36 connected to the curtain support members 33 when the platform assembly 15 is retracted. Guide means 41 move the outer wheel members 37 onto the outer wheel rails 35 when the platform assembly 15 is extended. The guide means 41 also moves the primary wheel members 36 onto the primary wheel tracks 39 and 39' of the magazine assembly 38 when the platform assembly 15 is retracted.

Figure 8:
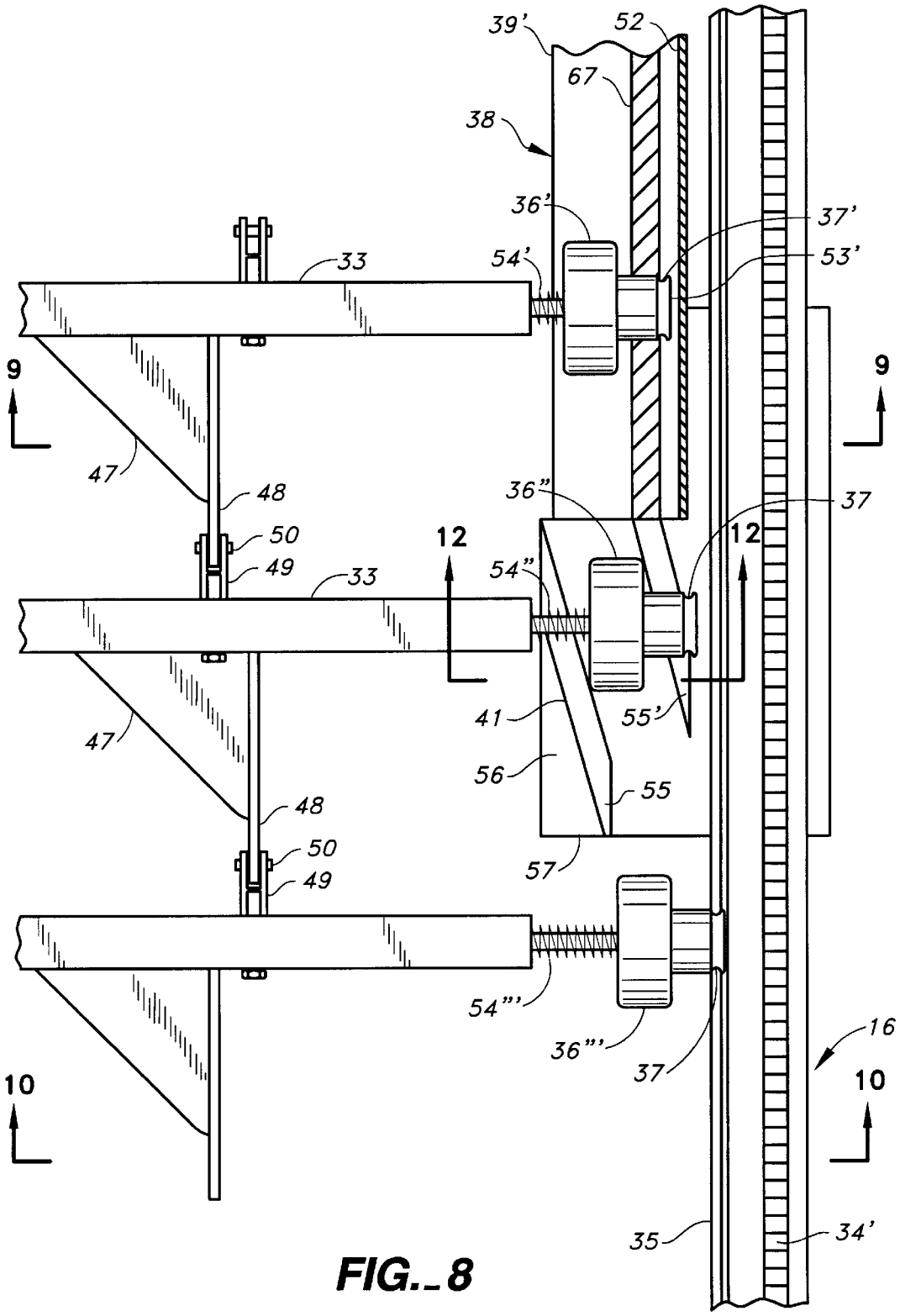
FIG. 8 is an enlarged top plan view of a portion of the platform assembly illustrating the movement of the primary wheel members of the curtain support members moving from the primary wheel track of the magazine assembly through the guide means and the extension and movement of the outer wheel members onto the outer wheel rail of the side rail.
Figure 9:
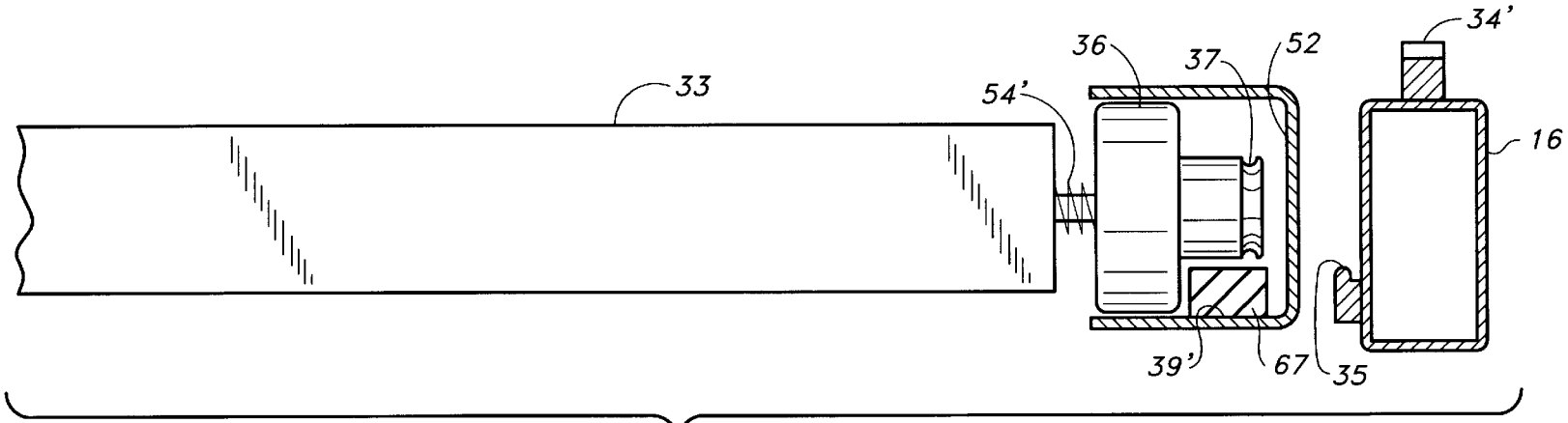
FIG. 9 is an enlarged scale front view of a portion of the primary wheel member riding within the primary wheel track.
Figure 10:
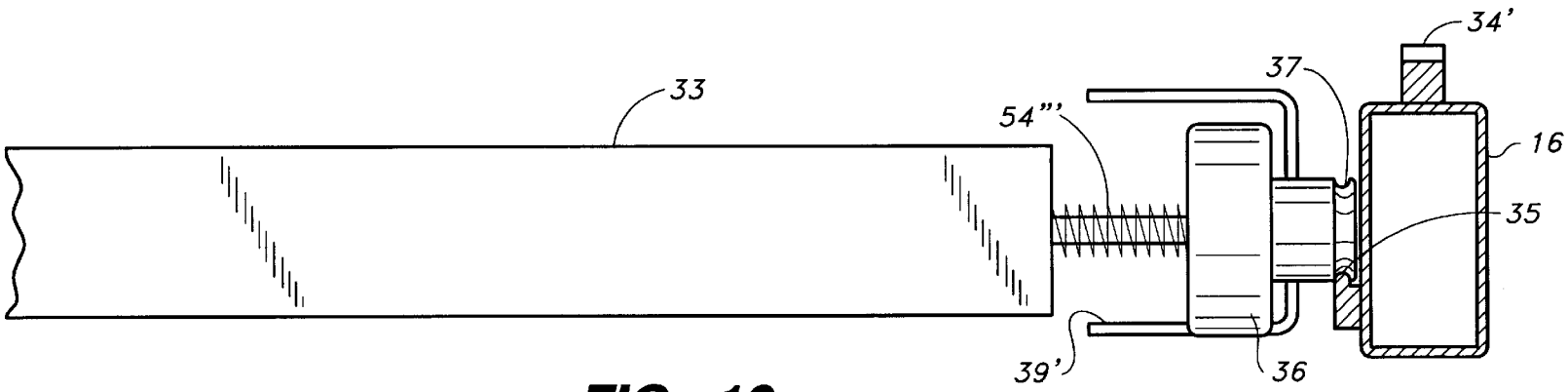
FIG. 10 is a view similar to FIG. 9 showing the outer wheel member riding on the outer wheel track of the side rail.

Referring to FIGS. 4(A–F), means 31 are provided for selectively lowering and raising the downstream delivery end 3 of the conveyor 4. As indicated in FIG. 1, means 32 and 32' are provided for retaining the spaced side rails 16 and 16' at a relatively horizontal position at all elevations of the downstream delivery end 3 of the conveyor 4. Spaced primary wheel tracks 39 and 39' as shown in FIGS. 5(A–C) are connected to conveyor means 4 for movement therewith and are pivotally connected to brackets 40 which are connected to mounting plates 20 and 20'. As illustrated in FIG. 8, magazine assembly 38 is positioned inboard of spaced side rails 16 and 16'.

In a preferred form of the invention, motor means 42 is operatively connected to and selectively extends and retracts platform assembly 15. It has been found that because of the speed with which the platform assembly 15 is extended and retracted and because of the inertia of the platform and the loads carried, it is necessary to provide brake means for selectively slowing the platform assembly as it approaches the extended position. It has been found that a regenerative motor drive system works satisfactorily. Brake means 44 may be used to hold the position of the platform after it has been stopped by the regenerative motor drive system.

Figure 18:
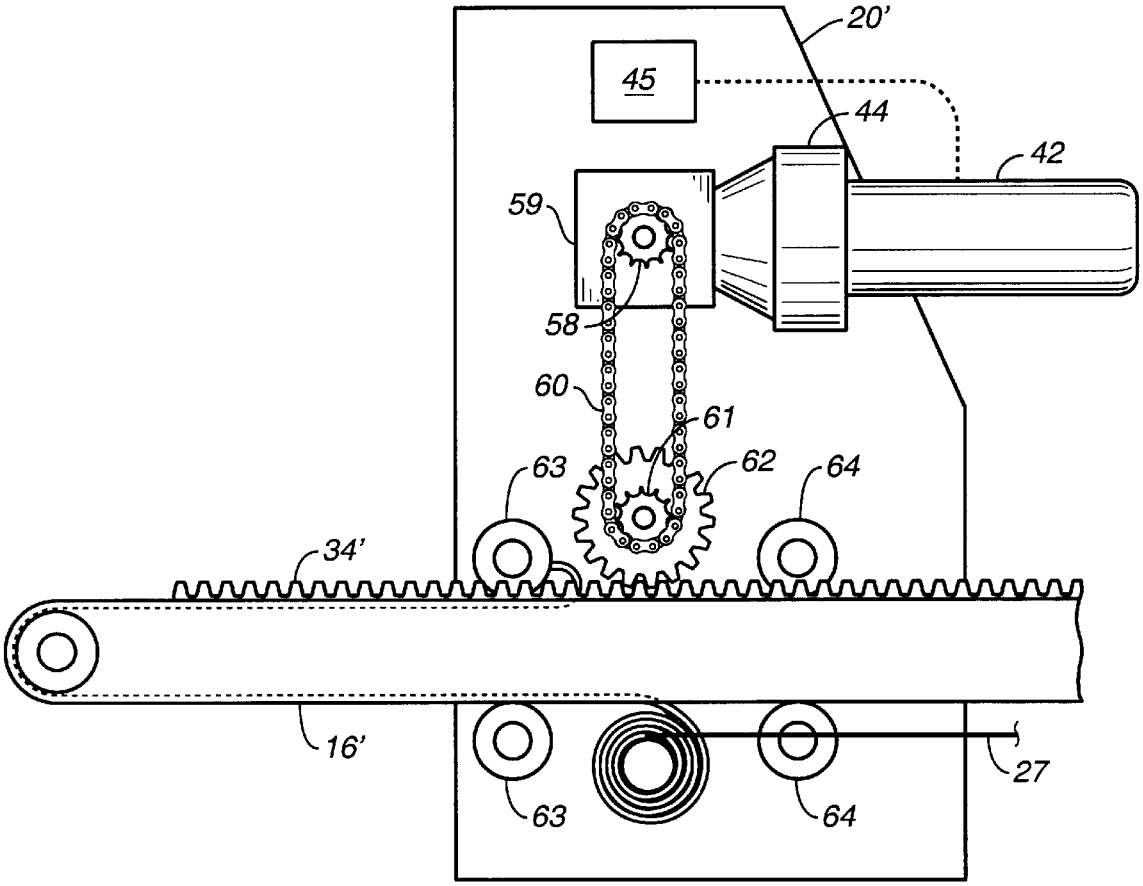
FIG. 18 is a side schematic view of a portion of the mechanism which extends and retracts the curtain member.
Figure 19:
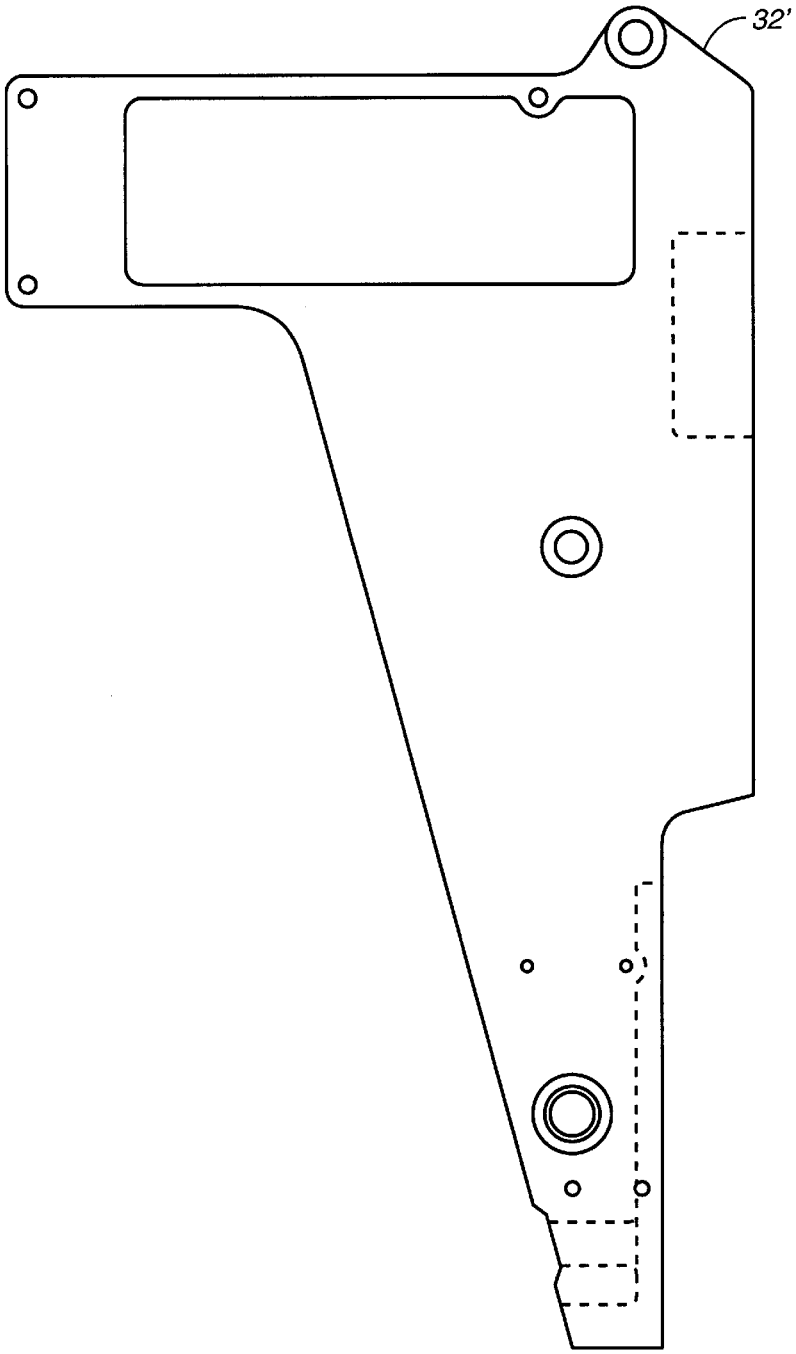
FIG. 19 is a side view of one of the means for maintaining a horizontal position.
Figure 20:
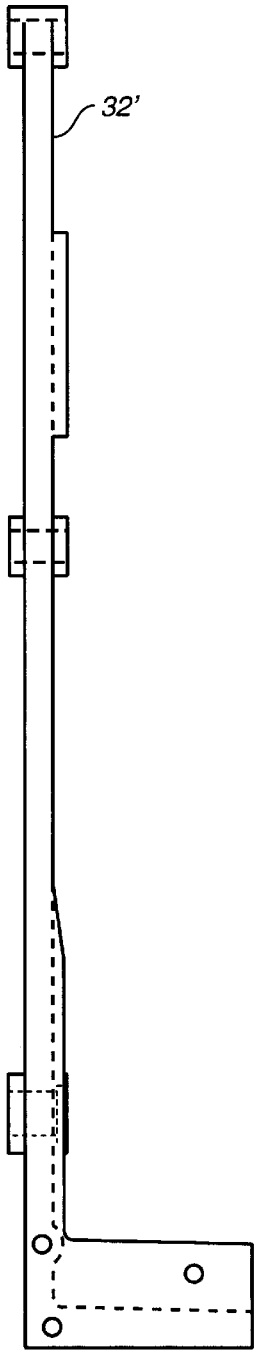
FIG. 20 is a front view of one of the means for maintaining a horizontal position.
Figure 22:
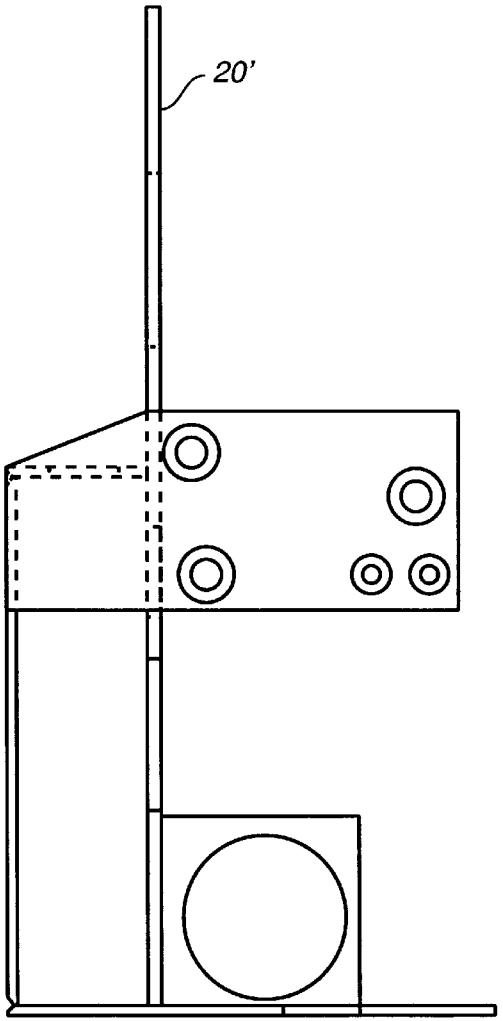
FIG. 22 is a front view of one of the mounting plates.
Figure 21:
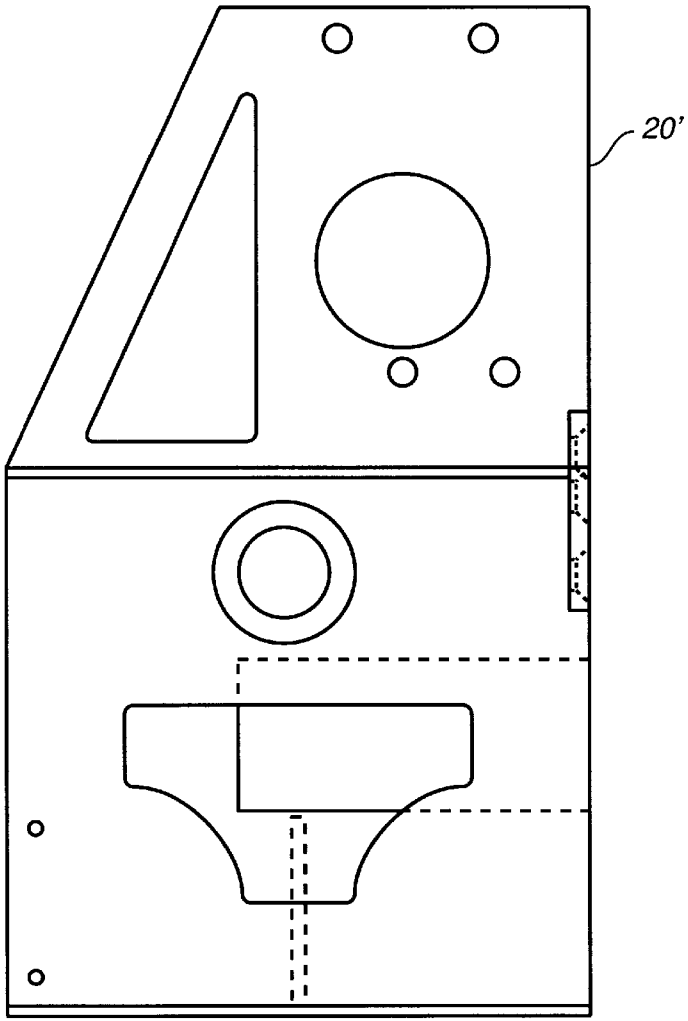
FIG. 21 is a side view of one of the mounting plates.
Figure 23:
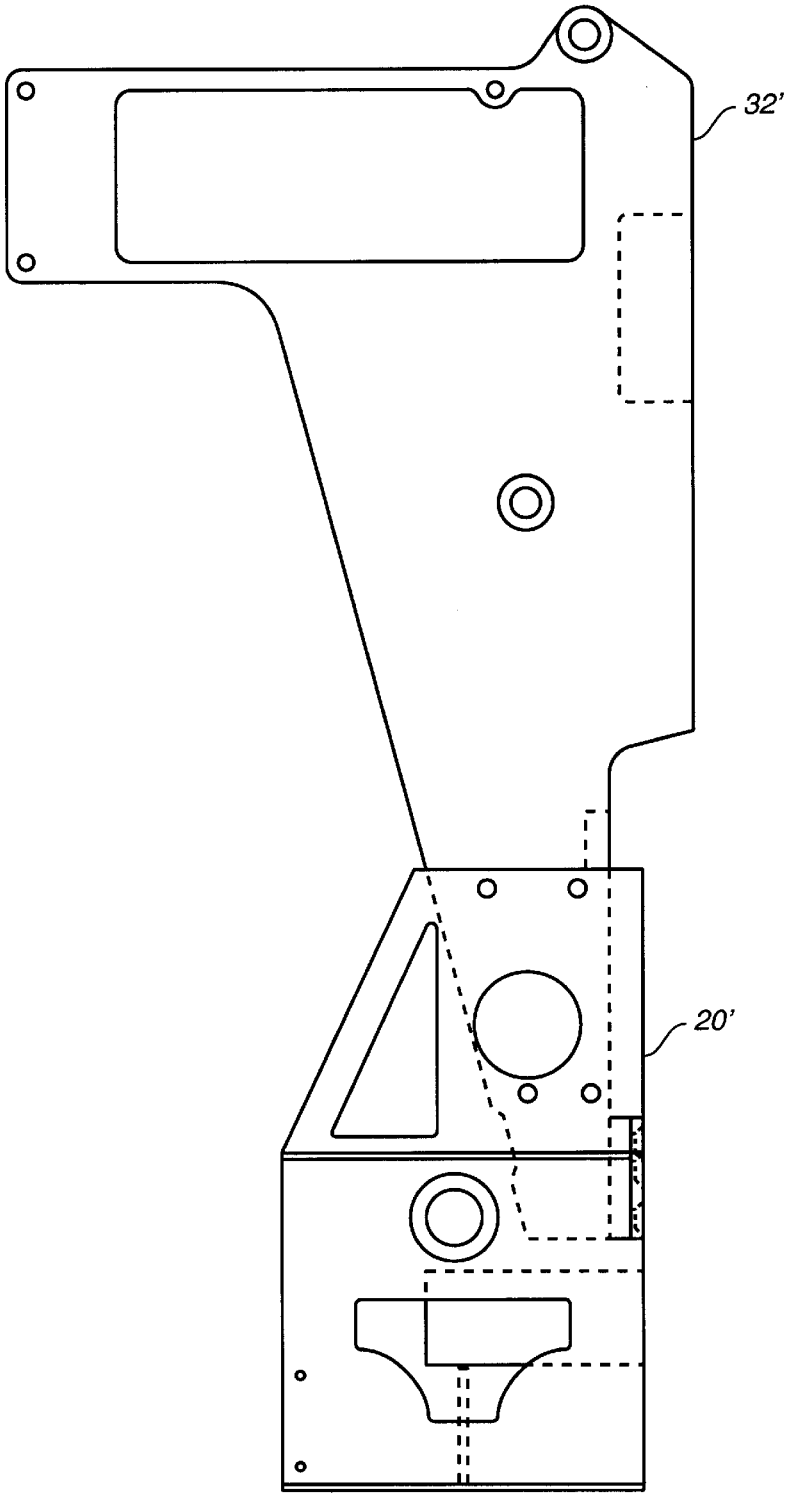
FIG. 23 is side view showing the connection of one of the mounting plates to one of the means for maintaining a horizontal position.
Figure 24:
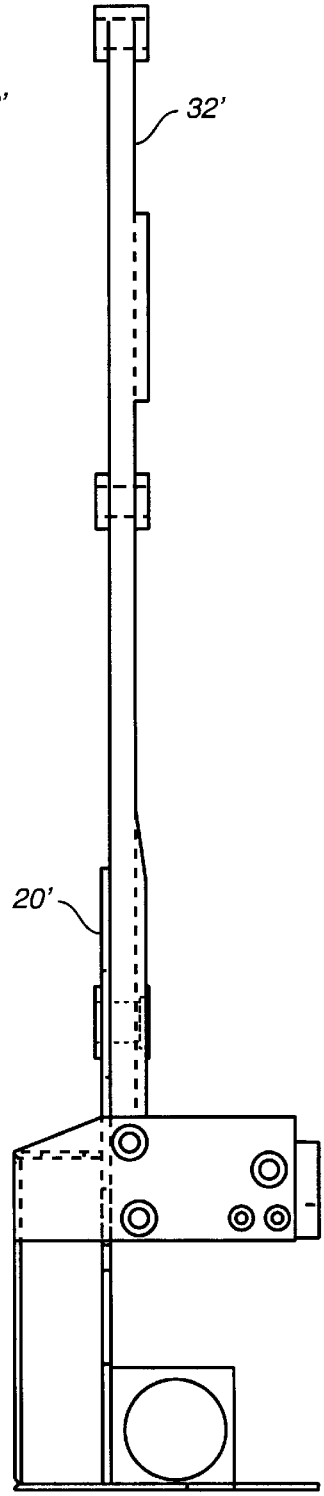
FIG. 24 is a front view showing the connection of one of the mounting plates to one of the means for maintaining a horizontal position.

Movement of the curtain 1 in effectively extending under and retracting from the stream of falling sheets is best accomplished by providing a control means 45 operatively connected to the motor means 42 as shown in FIG. 18. Control means 45 causes the motor 42 to rapidly extend the rack members 34 and 34' and leading edge roller 12 of the platform assembly 15 to a first intermediate position, as illustrated in FIG. 4C, in contact with a selected sheet identified as the first sheet 2" to be accumulated on the platform assembly 15. After contact is made with first sheet 2", the control means 45 extends platform assembly 15 at a reduced and preferably constant rate to a second selected position (not shown) which is outwardly from the first position. Finally, the control means 45 extends platform assembly 15 at a decelerating rate to the extended position shown in FIG. 4D.

It has been found that the zero feed interrupt sheet stacker S of the present invention when brought under the control of control means 45 is so precise that the motor means 42 is able to extend the leading edge roller 12 of the platform assembly 15 between selected sheets 2' and 2" descending from the delivery end 3 of the conveyor 4 even though the sheets 20 are shingled as illustrated in FIGS. 4(A–D).

One mode of keeping the curtain 1 taught during extension and retraction of the platform assembly 15 is shown in FIGS. 14–17. A scrolling means such as a hollow tube 14, having distal ends 26 and 26' is provided upon which the curtain 1 is spirally wound and unwound. A first tensioning spring 24 is mounted within the hollow tube 14 for driving the rotation of the tube 14 to retract curtain 1. It has been found in practicing this embodiment of tensioning the curtain 1 that to maintain the curtain 1 in tension at all times in order to minimize wrinkling which could cause interference with the operation of the curtain 1 it is necessary to provide a tensioning means operatively connected to the scrolling means.

As shown in FIGS. 14–17, the tensioning means includes cable take up reels 25 and 25' connected to the distal ends 26 and 26' of the hollow tube 14; a pair of second tensioning springs 28 mounted to assist the scrolling means in maintaining the curtain 1 in tension; and a pair of cables 27, each connected to one of the cable take up reels 25 and 25' connected to the distal ends of the hollow tube 14 and each connected to one of the second tensioning springs 28.

Figure 25:
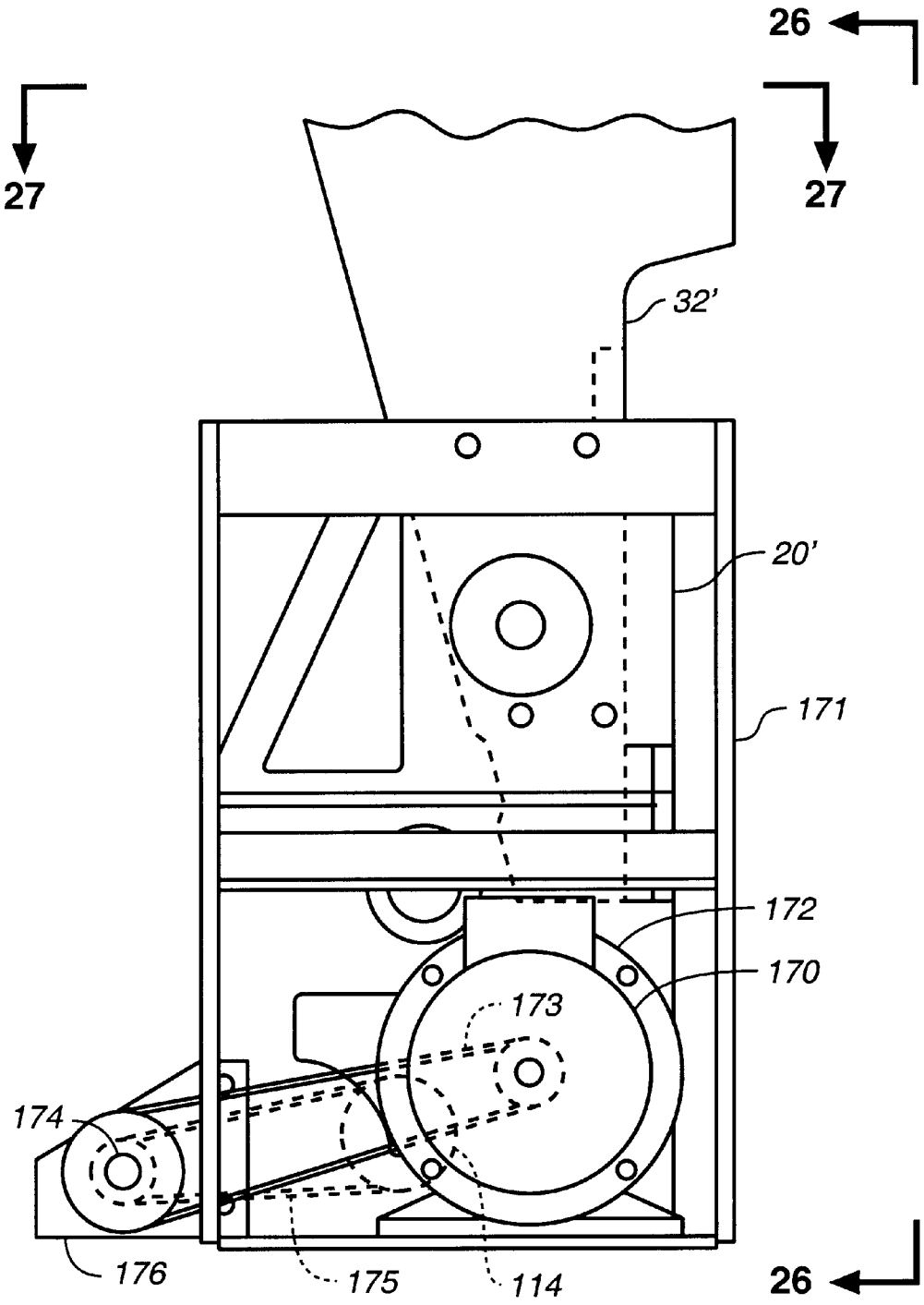
FIG. 25 is a side view of one of the mounting plates. It is shown connected to one of the means for maintaining a horizontal position. The curtain tension motor is shown mounted on one of the mounting plates by means of a curtain tension motor support bracket. An alternate embodiment of the curtain take up roll is shown in phantom lines.
Figure 27:
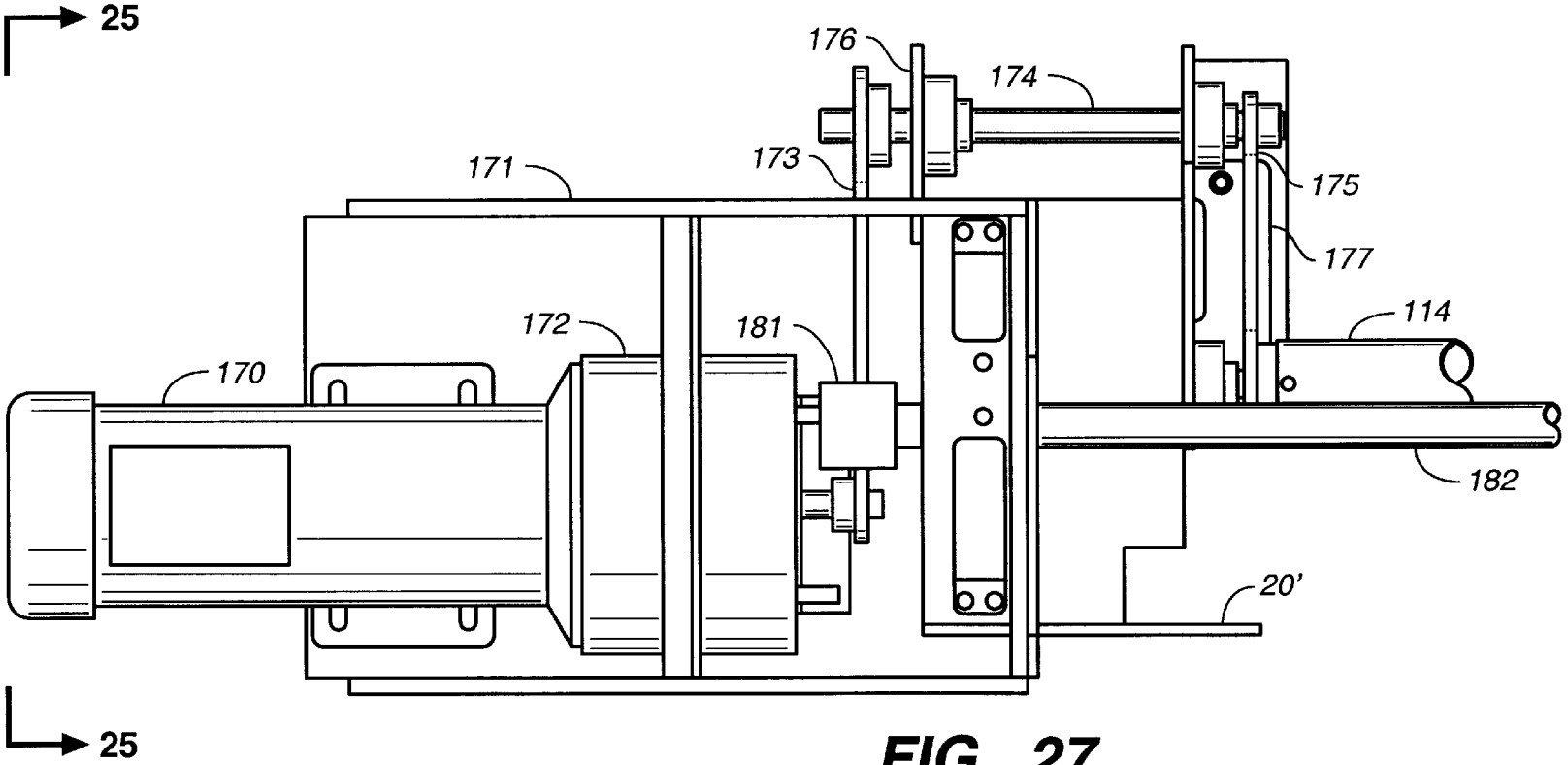
FIG. 27 is a top plan view taken along line 27—27 of FIG. 25. The means for maintaining a horizontal position has been omitted for clarity. The take up roll drive train that connects the curtain tension motor to the curtain take up roll is shown.

In the preferred embodiment, the scrolling means is a cylindrical take up roll 114 which has no internal tension spring 24, and the tensioning means is a curtain tension motor 170 operatively connected to the curtain take up roll 114. This alternate embodiment for keeping the curtain 1 taught is shown in FIGS. 25 through 27. When the curtain tension motor 170 is operating it turns the cylindrical, curtain take up roll 114 in a direction that winds the curtain 1 onto the curtain take up roll 114.

Tension on the curtain 1 is varied by varying the torque generated by the curtain tension motor 170. During the initial and middle phases of the extension of the platform assembly 15, the curtain tension motor 170 provides little resistance. As the platform assembly 15 approaches its full extension and slows the curtain tension motor 170 provides greater torque, increasing the tension on the curtain 1, preventing any slack or wrinkles from developing. During the retraction of the platform assembly 15, the curtain tension motor 170 has to start tensioning the curtain 1 before the platform assembly 15 starts to retract in order to keep the curtain 1 taught, but otherwise the curtain tension motor 170 tracks the accumulator motor means 42. The curtain tension motor 170 increases the torque on the curtain take up roll 114 just ahead of the initial accelerating phase generated by the accumulator motor means 42 to start the platform assembly 15 retracting. During the middle constant velocity phase of the retraction of the platform assembly 15, the curtain tension motor 170 maintains a constant torque. When the accumulator motor means 42 starts to slow down at the end of the retraction, the curtain tension motor 170 means reduces torque as well.

As shown in FIG. 27, the curtain tension motor 170 is mounted on a curtain tension motor support bracket 171 which is mounted on mounting plate 20'. The curtain tension motor 170 is provided with a curtain tension motor brake 172. A first drive chain 173 connects the curtain tension motor 170 to the take up roll drive train 174. A second drive chain 175 connects the take up roll drive train 174 to the curtain take up roll 114. The first and second drive chains 173 and 175 and the take up roll drive train 174 transmit torque from the curtain tension motor 170 to the curtain take up roll 114.

The take up roll drive train 174 is attached to the mounting plate 20' by means of first and second drive train mounting brackets 176 and 177. The second drive train mounting bracket 177 also connects the curtain take up roll 114 to the mounting plate 20'. These brackets 176 and 177 are best seen in FIG. 27. FIG. 27 also shows the accumulator drive train 182 which transmits the mechanical power from the accumulator motor means 42 mounted on the opposite side of the sheet stacker to drive rail 16' mounted on the side of the sheet stacker shown in FIG. 27.

The curtain tension motor 170, like the motor means 42, is also controlled by control means 45.

Figure 28:
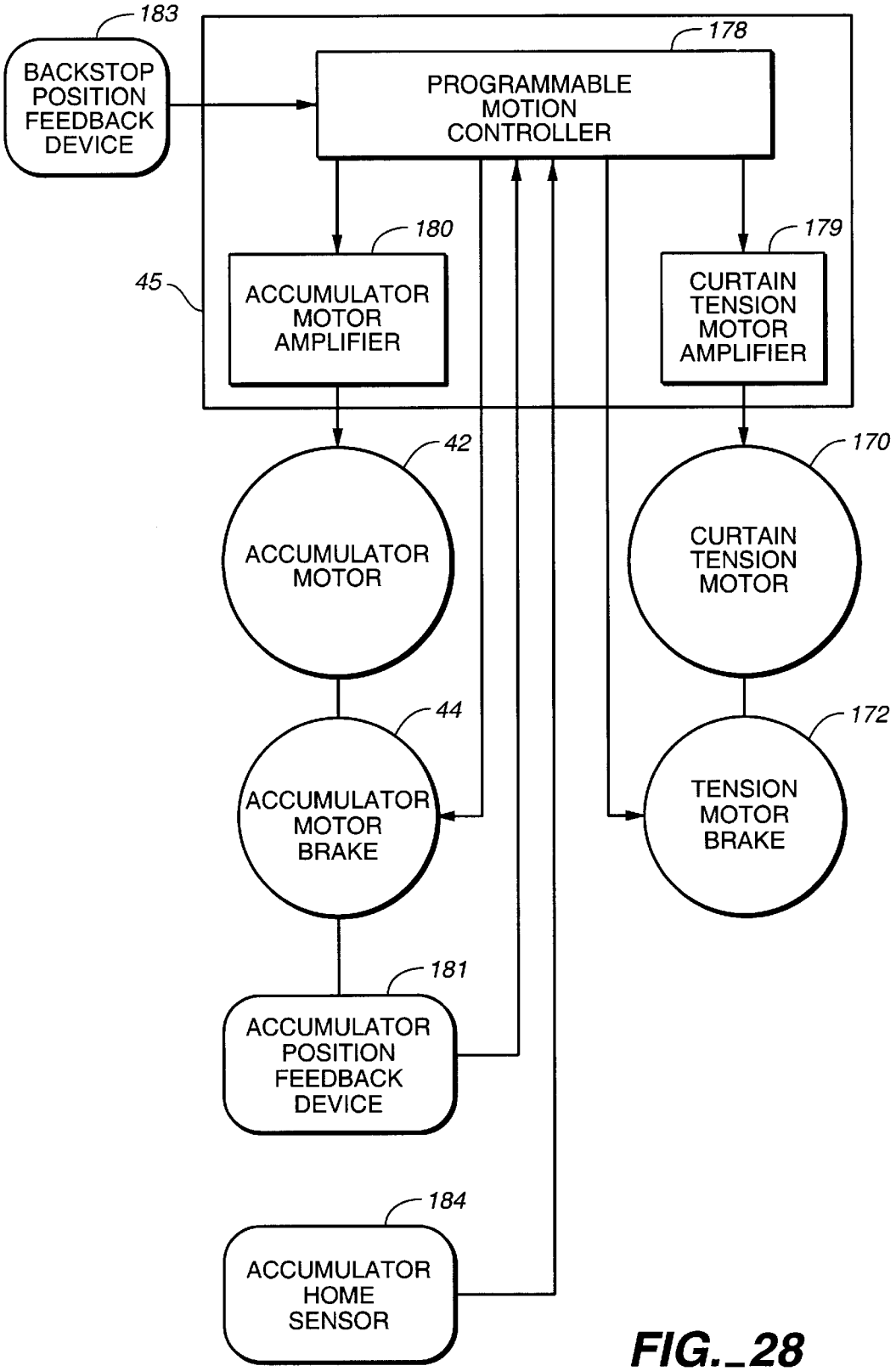
FIG. 28 is a schematic of the means for extending and retracting the platform assembly and for keeping tension on the curtain.

As shown in FIG. 28, in the preferred embodiment, control means 45 consists of a motion controller 178, a curtain tension motor amplifier 179 and an accumulator motor means amplifier 180. Motion controller 178 is programmable by software or other simple means, and is preferably a programmable logic controller, but could also be a computer or similar control device. The accumulator motor means amplifier 180 controls the motor means 42 velocity by converting the low level command signal generated by the motion controller 180 to a high voltage/current command that drives accumulator motor means 42. The curtain tension motor amplifier 179 controls the torque of the curtain tension motor 170 by converting the low level command signal generated by the motion controller 178 to a high voltage/current command that drives the curtain tension motor 170.

The motion controller 178 is also directly connected to the brake means 44 for the accumulator motor means 42, telling it to activate or deactivate. When the brake means 44 for the accumulator motor means 42 is activated or engaged, the side rails 16 and 16' that control the extension and retraction of the platform assembly 15 are locked in place. The brake means 44 is engaged to hold the platform assembly 15 when it has reached its desired extension and to hold the platform assembly 15 when it is retracted and not being used.

The motion controller 178 is also directly connected to the curtain tension motor brake 172, telling it to engage or disengage. When the curtain tension motor brake 172 is engaged the curtain take up roll 114 is locked and cannot wind or unwind. The curtain tension motor brake 172 is engaged when the platform assembly 15 is fully extended into the stream of sheets 2, and when it is retracted to allow the sheets 2 to fall past the sheet accumulator means 7.

The motion controller 178 receives input from a variety of different sources to control the tension on the curtain 1 and the extension and retraction of the platform assembly 15. A backstop member position feedback device 183 provides the motion controller 178 with the absolute position of the backstop member 17. The motion controller 178 uses this information to determine how far to extend the platform assembly 15. A platform assembly position feedback device 181, shown in FIG. 26, provides the motion controller 18 with platform assembly's position, direction and rate of travel. A platform assembly home sensor 184 instructs the motion controller 178 when the platform assembly 15 is fully retracted.

The motion controller 178 can use this information to recalibrate the platform assembly position feedback device 181, if necessary.

Description and operation of the platform assembly 15

Since curtain 1 as presently constituted is made of a thin and flexible material, and support must be provided beneath the curtain 1 which is capable of holding a load of sheets. The construction and operation of platform assembly 15 may be understood by referring to FIGS. 2, 4(A–F), 5(A–C), and 7–10.

Referring first to FIG. 2, platform assembly 15, which is part of accumulator assembly 7, is shown in its retracted position. The long rectangular hollow tubes 33 which make up the curtain support members are stiffened by full gussets 46 and half gussets 47. As previously described, the curtain support members are provided with primary wheel members 36 which ride in primary wheel tracks 39 and 39'. As shown in FIGS. 5(A–C) and 7, each curtain support member 33 is joined to another curtain support member 33 by strut members 48. Because the platform assembly 15 must change elevational direction, the platform assembly is articulated by attaching a pivot bracket 49 to each curtain support member 33 and joined to each strut member 48 with a pivot pin 50. To further rigidize the platform assembly, front cross tubes 51 and 51' located behind the leading edge member 12 are joined at their ends to side rails 16 and 16'. The first pivot bracket 49' of the first strut member 48' is attached directly to the front cross tube 51'.

When platform assembly 15 is extended, movement from magazine assembly 38 to the side rails 16 and 16' is best seen by referring to FIG. 8. Primary wheel member 36' is shown riding on primary wheel track 39' with upright member 52 adjacent the end face 53' of outer wheel member 37'. Plastic wheel guides 67 running the length of wheel tracks 39' and 39 force primary wheel member 36 toward the end of curtain support member 33 thereby compressing spring 54'. As wheel 36" leaves primary wheel track 39' it is no longer confined by plastic wheel guides 67 and spring 54" forces primary wheel member 36" away from curtain support member 33 where it is further guided by guide means 41 consisting of uprights 55 and 55' shown in FIGS. 8 and 12. As wheel 36" leaves guide means 41 and the force exerted by plastic wheel guide 67, it rides down a ramp 56 and off ramp end 57 where it is no longer supported. Simultaneously, as wheel 36'" loses support, compression spring 54'" forces outer wheel 37 onto outer wheel rail 35 which in turn is mounted on side rail 16' thereby supporting and maintaining curtain support members 33 at a constant elevation.

When platform assembly 15 is retracted, the sequence of events just described is simply reversed and need not be further described.

Side rails 16 and 16' are mounted for reciprocating movement as illustrated in FIG. 18. When motor 42 is activated, sprocket 58 mounted on gear box 59 drives chain 60 which in turn drives a sprocket 61 connected to rack gear 62 which engages the teeth of rack member 34'.

Side rail 16' is maintained in a straight line by pairs of guide wheels 63 and 64.

Figure 11:
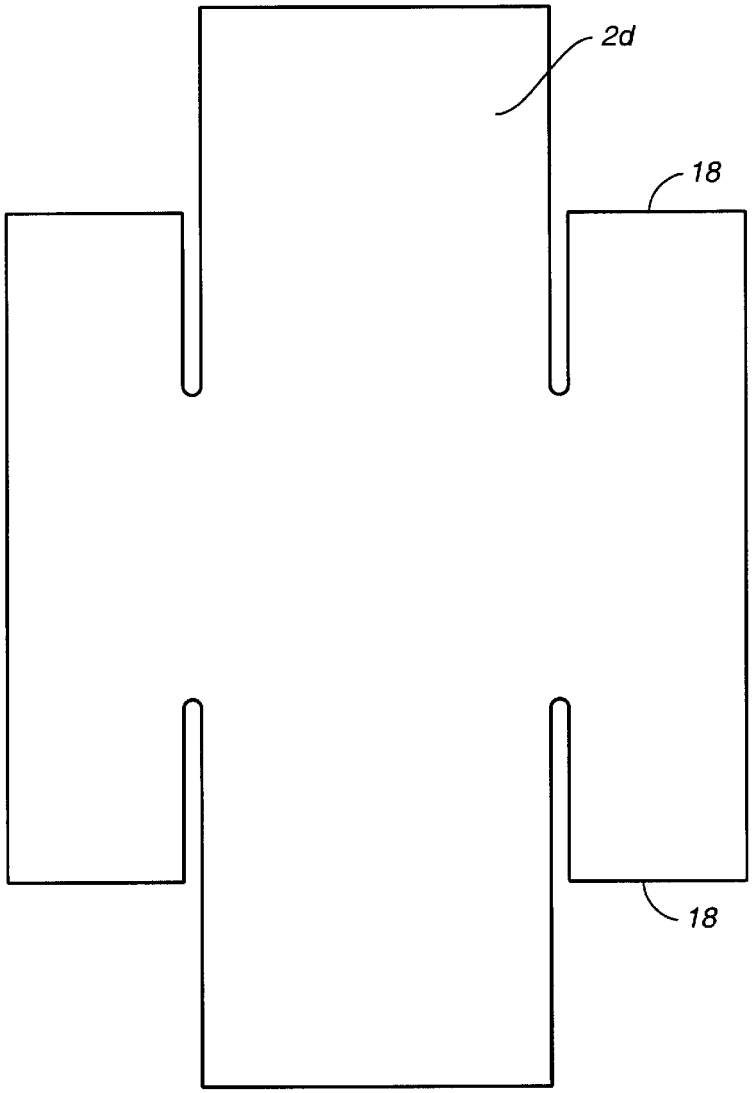
FIG. 11 is a top plan view of a die cut sheet blank.
Figure 12:
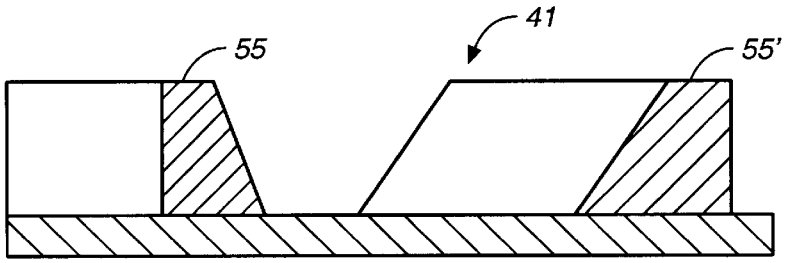
FIG. 12 is a cross sectional view taken along line 12—12 of FIG. 8.
Figure 13A:
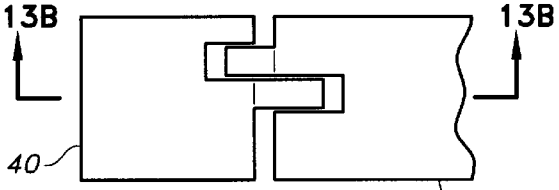
FIG. 13A is a top plan view of the joint between primary wheel track and the transition bracket of the magazine assembly taken generally in the vicinity of line 13D—13D of FIG. 5C with the primary wheel track approximately horizontal to the transition bracket and the side rail.
Figure 13B:
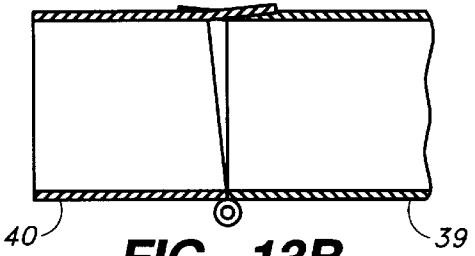
FIG. 13B is a cross sectional side view of the joint taken along line 13B—13B of FIG. 13A.
Figure 13C:
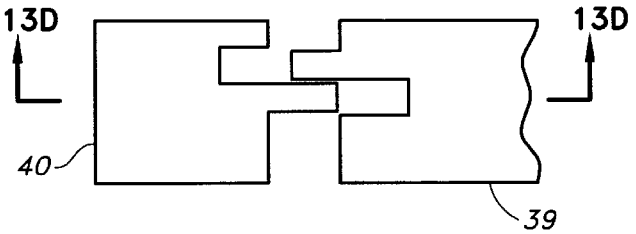
FIG. 13C is a top plan view of the joint between the primary wheel track and the transition bracket of the magazine assembly taken generally in the vicinity of line 13D—13D of FIG. 5C with the primary wheel track in a down position as would be the case of the position of the conveyor in solid line in FIG. 6.
Figure 13D:
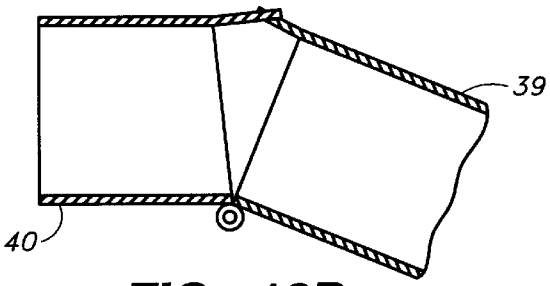
FIG. 13D is a cross sectional side view of the joint taken along line 13D—13D in FIG. 13C.
Figure 13E:
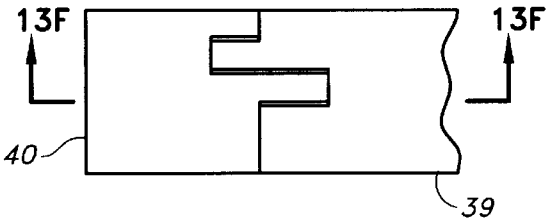
FIG. 13E is a top plan view of the joint between the primary wheel track and the transition bracket of the magazine assembly taken generally in the vicinity of line 13D—13D of FIG. 5C with the primary wheel track in an up position as would be the case of the position of the conveyor in phantom line in FIG. 6.
Figure 13F:
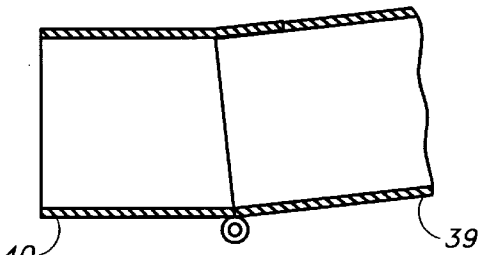
FIG. 13F is a cross sectional side view of the joint taken along line 13F—13F as shown in FIG. 13E.

FIG. 11 illustrates sheet 2*d* which is one of many types of sheets 2 which might be carried by the machine of the present invention. Note that flap 18 is designated and which is also shown in FIG. 4C.

Figure 3:
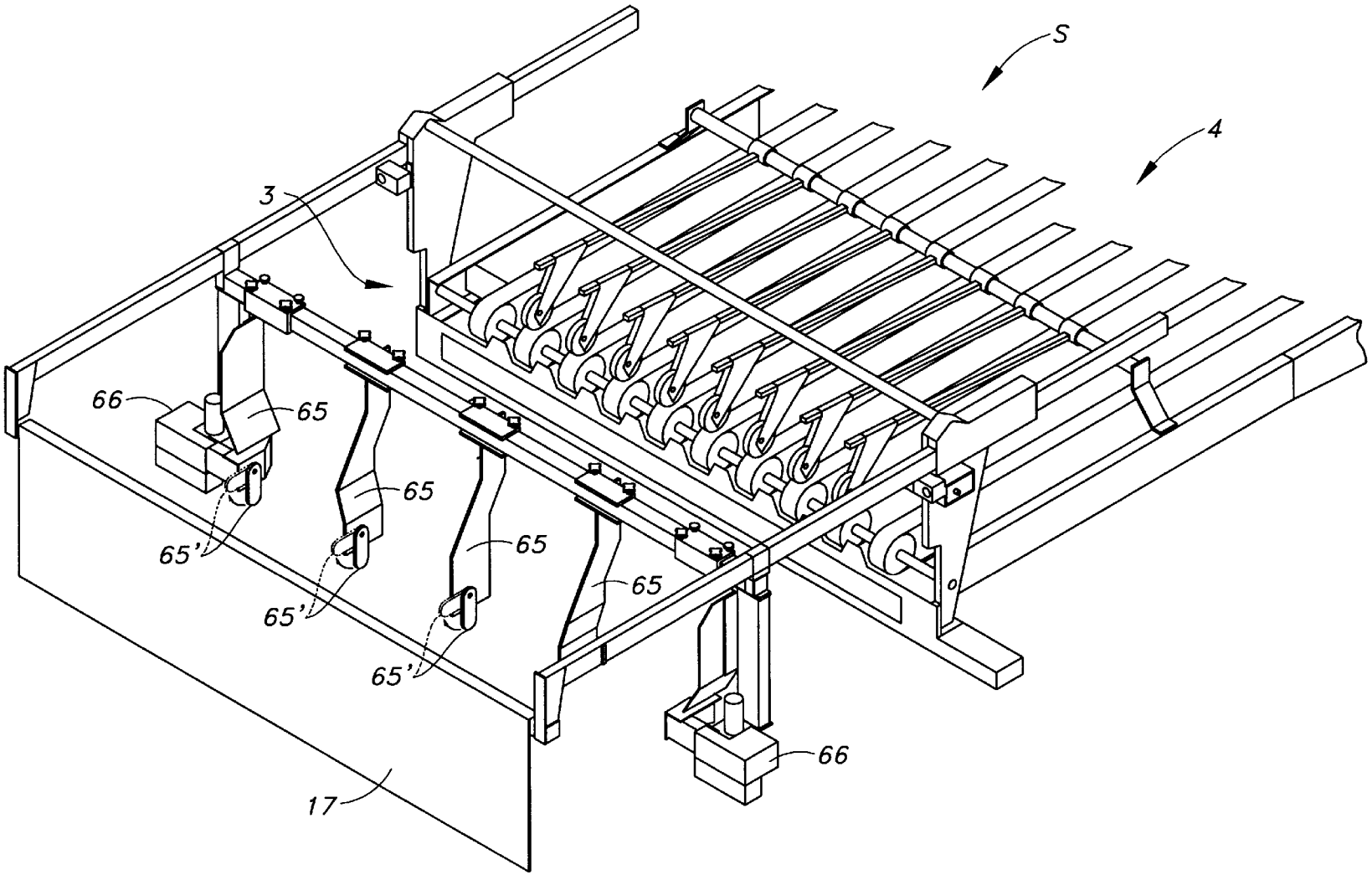
FIG. 3 is an isometric view of a detailed view of a portion of the conveyor and the downstream delivery end of the conveyor shown in FIG. 1. Also shown is the paddle mounting member and opening for the platform assembly and curtain member shown in FIG. 2. The back stop member side sheet guides and side tampers are shown schematically.

As shown in FIG. 3, side sheet guides 65 with pivotal extensions 65' may be provided. Additionally side tampers 66 assist in keeping the stack 6 vertical.

We claim:

1. A zero feed interrupt sheet stacker comprising:

a. conveyor means delivering an uninterrupted stream of sheets from an upstream receiving end to a downstream delivery end wherein said sheets free fall in an uninterrupted stream in a downwardly arcuate path;

b. load receiving means for receiving said sheets at a first location;

c. sheet accumulator means mounted below said delivery end of said conveyor means and above said load receiving means movable between a retracted position out of said downwardly uninterrupted stream of sheets and an extended position temporarily receiving said stream of sheets;

d. backstop means mounted downstream and below said downstream delivery end of said conveyor restraining the forward motion of said sheets;

e. said sheet accumulator means having a rapid deployment extension and retraction platform assembly having a variable area supporting platform including a moving leading edge member, and a rack member connected to said leading edge member, said leading edge member selectively extending into said stream of falling sheets between selected sheets in said stream providing an increasing supporting platform area as extension increases and said increasing platform area in contact with a sheet member remaining substantially motionless in a horizontal direction relative to said sheet member as said moving leading edge member of said platform assembly extends into said stream of falling sheets toward said backstop means and accumulate thereon, and said platform assembly selectively retracting from said stream of falling sheets providing in a horizontal direction a non-moving decreasing support area relative to said accumulated sheets in contact with said platform area during retraction of said platform assembly from said accumulated sheets on said sheet accumulator means and depositing said sheets on said load receiving means;

f. power means operatively connected to and selectively extending and retracting said platform assembly; and g. control means operatively connected to said power means rapidly extending said rack member and said leading edge member of said platform assembly to a first intermediate position in contact with a selected sheet identified as the first sheet to be accumulated on said platform assembly; extending said platform assembly at a reduced rate to a second position outwardly of said first position; and extending said platform assembly at a decelerating rate to said extended position outwardly from said second position; and wherein said sheets on said conveyor means are shingled, and said control means and power means are operative to extend said leading edge roller of said platform assembly between selected sheets descending from said delivery end of said conveyor.

2. A zero feed interrupt sheet stacker as described in claim 1 wherein a. said leading edge member is formed with a curvilinear edge; and b. said platform assembly includes a curtain member engaging said leading edge member.

3. A zero feed interrupt sheet stacker as described in claim 2 wherein:

a. said leading edge member is an elongated roller mounted for rotation.

4. A zero feed interrupt sheet stacker as described in claim 2 wherein said accumulator means comprises:

a. said curtain member is formed with a first end and a second end;

b. means fixedly attaching said first end of said curtain; and c. scrolling means attached to said second end for spirally winding said curtain.

5. A zero feed interrupt sheet stacker as described in claim 4 comprising:

a. said scrolling means including a hollow tube and having distal ends;

b. a first tensioning spring carried within said hollow tube for driving said tube to retract said curtain; and c. tensioning means operatively connected to said scrolling means including:

1. cable take up reels connected to said distal ends of said hollow tube;

2. a pair of second tensioning springs mounted to assist said scrolling means in maintaining said curtain in tension;

3. a pair of cables each connected to one of said cable take up reels connected to said distal ends of said hollow tube and each connected to one of said second tensioning springs.

6. A zero feed interrupt sheet stacker as described in claim 2 comprising:

a. said sheet accumulator means including curtain support members operatively connected to said leading edge member for extension and retraction movement therewith and connected to one another in a chain.

7. A zero feed interrupt sheet stacker as described in claim 6 comprising:

a. said accumulator means including a pair of spaced side rails and said rack member carried thereon;

b. outer wheel rails mounted on said spaced side rails; and c. said spaced side rails carrying said leading edge member.

8. A zero feed interrupt sheet stacker as described in claim 7 comprising:

a. primary wheel members connected to said curtain support members;

b. outer wheel members mounted outwardly of said primary wheel members on said curtain support members for operative engagement with said outer wheel rails on said side rails;

c. a magazine assembly connected to said conveyor means and including a pair of spaced primary wheel tracks for receiving and supporting said primary wheel members connected to said curtain support member when said platform assembly is retracted; and e. guide means moving said outer wheel members onto said outer wheel rails when said platform assembly is extended and moving said primary wheel members onto said primary wheel tracks of said magazine assembly when said platform assembly is retracted.

9. A zero feed interrupt sheet stacker as described in claim 8 comprising:

a. means selectively lowering and raising said downstream delivery end of said conveyor means;

b. means retaining said spaced side rails at a relatively horizontal position at all elevations of said downstream delivery end of said conveyor means including a mounting bracket and a transition bracket connected thereto;

c. said spaced primary wheel tracks of said magazine assembly are connected to said conveyor means for movement therewith and are pivotally connected to said transition bracket; and d. said magazine assembly is positioned inboard of said spaced side rails.

10. A zero feed interrupt sheet stacker as described in claim 1 comprising:

a. means selectively lowering and raising said downstream delivery end of said conveyor means; and b. means retaining said platform assembly of said accumulator means at a relatively horizontal position at all elevations of said downstream delivery end of said conveyor means.

11. A zero feed interrupt sheet stacker as described in claim 10 comprising:

a. said load receiving means having a first location;

b. means for selectively moving said load receiving means away from said first location.

12. A zero feed interrupt sheet stacker comprising:

a. conveyor means delivering an uninterrupted stream of sheets from an upstream receiving end to a downstream delivery end wherein said sheets descend in a spaced and uninterrupted stream;

b. load receiving means for receiving said sheets;

c. sheet accumulator means mounted below said delivery end of said conveyor means and above said load receiving means movable between a retracted position out of said downwardly uninterrupted stream of sheets and an extended position temporarily receiving said stream of sheets;

d. means restraining the forward motion of said sheets after exiting said downstream delivery end of said conveyor means; and e. said sheet accumulator means having a rapid deployment extension and retraction platform assembly having a variable area supporting platform including a moving leading edge member selectively extending into said stream of descending sheets between selected sheets in said stream providing an increasing supporting platform area as extension increases and said increasing platform area in contact with a sheet member remaining substantially motionless in a horizontal direction relative to said sheet member as said moving leading edge member of said platform assembly extends into said stream of falling sheets and accumulate thereon, and said platform assembly selectively retracting from said stream of descending sheets providing in a horizontal direction a non-moving decreasing support area relative to said accumulated sheets in contact with said platform area during retraction of said platform assembly from said accumulated sheets on said sheet accumulator means and depositing said sheets on said load receiving means, wherein said leading edge member is formed with a curvilinear edge, and said platform assembly includes a curtain member engaging said leading edge member, said curtain member having a first end and a second end, said platform assembly having means fixedly attaching said first end of said curtain and scrolling means attached to said second end for spirally winding said curtain, and said scrolling means is a cylindrical take up roll onto which said curtain member can be wound, and said platform assembly includes a curtain tension motor operatively connected to said scrolling means so that when said curtain tension motor is operating it turns said cylindrical take up roll in a direction that winds said curtain onto said cylindrical take up roll.

13. A zero feed interrupt sheet stacker comprising:

a. conveyor means delivering an uninterrupted stream of sheets from an upstream receiving end to a downstream delivery end wherein said sheets free fall in an uninterrupted stream in a downwardly arcuate path;

b. load receiving means for receiving said sheets at a first location;

c. sheet accumulator means mounted below said delivery end of said conveyor means and above said load receiving means movable between a retracted position out of said downwardly uninterrupted stream of sheets and an extended Position temporarily receiving said stream of sheets;

d. backstop means mounted downstream and below said downstream delivery end of said conveyor restraining the forward motion of said sheets; and e. said sheet accumulator means having a rapid deployment extension and retraction platform assembly having a variable area supporting platform including a moving leading edge member selectively extending into said stream of falling sheets between selected sheets in said stream providing an increasing supporting platform area as extension increases and said increasing platform area in contact with a sheet member remaining substantially motionless in a horizontal direction relative to said sheet member as said moving leading edge member of said platform assembly extends into said stream of falling sheets toward said backstop means and accumulate thereon, and said platform assembly selectively retracting from said stream of falling sheets providing in a horizontal direction a non-moving decreasing support area relative to said accumulated sheets in contact with said platform area during retraction of said platform assembly from said accumulated sheets on said sheet accumulator means and depositing said sheets on said load receiving means, wherein said leading edge member is formed with a curvilinear edge, and said platform assembly includes a curtain member engaging said leading edge member, said curtain member having a first end and a second end, said platform assembly having means fixedly attaching said first end of said curtain and scrolling means attached to said second end for spirally winding said curtain, and said scrolling means is a cylindrical take up roll onto which said curtain member can be wound, and said platform assembly includes a curtain tension motor operatively connected to said scrolling means so that when said curtain tension motor is operating it turns said cylindrical take up roll in a direction that winds said curtain onto said cylindrical take up roll.

* * * * *